US007134924B2

(12) United States Patent
Takada et al.

(10) Patent No.: US 7,134,924 B2
(45) **Date of Patent: *Nov. 14, 2006**

(54) OUTBOARD MOTOR STEERING SYSTEM

(75) Inventors: Hideaki Takada, Wako (JP); Hiroshi Mizuguchi, Wako (JP); Hiroshi Watabe, Wako (JP); Yoshinori Masubuchi, Wako (JP); Taiichi Otobe, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/446,966

(22) Filed: May 29, 2003

(65) Prior Publication Data

US 2003/0224670 A1 Dec. 4, 2003

(30) Foreign Application Priority Data

May 31, 2002 (JP) ..... 2002-160321
May 31, 2002 (JP) ..... 2002-160322
May 31, 2002 (JP) ..... 2002-160323

(51) Int. Cl.
*B63H 20/08* (2006.01)
*B63H 25/42* (2006.01)

(52) U.S. Cl. ..... 440/61 R; 440/61 S

(58) Field of Classification Search ..... 440/53–63, 440/76–78; 114/144 R, 150
See application file for complete search history.

(56) References Cited

U.S. PATENT DOCUMENTS 3,946,698 A * 3/1976 LaFollette et al. ..... 440/60
4,449,945 A * 5/1984 Ferguson ..... 440/53
4,545,770 A * 10/1985 Ferguson ..... 440/61 R
4,735,590 A * 4/1988 Mondek ..... 440/88 L
4,836,810 A * 6/1989 Entringer ..... 440/61 R
5,472,361 A * 12/1995 Fujimoto et al. ..... 440/89 R
5,505,641 A * 4/1996 Onoue ..... 440/61 R
6,416,370 B1 * 7/2002 Bland et al. ..... 440/61 R
6,883,451 B1 * 4/2005 Takada et al. ..... 114/144 R

FOREIGN PATENT DOCUMENTS

CA 1 053 083 4/1979
CA 1 208 986 8/1986
JP 02-279495 11/1990
JP 02279495 A * 11/1990
JP 07-228296 8/1995

OTHER PUBLICATIONS

Translation of JP 02-279495 A.*

* cited by examiner

*Primary Examiner*—S. Joseph Morano
*Assistant Examiner*—Ajay Vasudeva
(74) *Attorney, Agent, or Firm*—Westerman, Hattori, Daniels & Adrian, LLP.

(57) ABSTRACT

A steering system of an outboard motor is provided that is mounted on a stern of a boat and having an internal combustion engine at its upper portion and a propeller with a rudder at its lower portion that is powered by the engine to propel the boat. The steering system includes a cowl enclosing the engine and a hydraulic cylinder connected to the outboard motor at one end and to the boat at other end to swivel the outboard motor relative to the boat to steer the cowl, the propeller, and the engine about a vertical axis. The hydraulic cylinder is located inside a vertical plane of a profile of the outboard motor when viewed along the vertical axis such that the hydraulic cylinder never projects outside the profile in any steered position of the motor.

3 Claims, 23 Drawing Sheets

OUTBOARD MOTOR STEERING SYSTEM

BACKGROUND OF THE INVENTION

1. Field of the Invention

This invention relates to an outboard motor steering system.

2. Description of the Related Art

Almost all outboard motor steering systems have up to now been of types operated by human power, such as the tiller handle type used to turn the rudder by manually operating a tiller handle attached to the outboard motor and the remote control type used to remotely operate a steering mechanism through a push-pull cable. Further, an add-on mechanism constituted as a separate unit from the outboard motor and used to power-assist the turning of the tiller handle is known. As shown in FIG. 23, this mechanism typically includes a steering hydraulic cylinder 204 attached to the front (boat side) of an outboard motor 200 through stays 202, and a link mechanism 206 connected between the hydraulic cylinder 204 and a tiller handle 208.

Human-powered steering systems are disadvantageous because they tend to have an unpleasant steering "feel" owing to, for instance, heavy steering load. The add-on steering system using a hydraulic cylinder also has disadvantages, most notably that its structure is complicated, that it adds to the number and weight of the components, and that it takes up space between the front of the outboard motor and the rear of the boat.

Attempts have been made to overcome these drawbacks. Japanese Laid-Open Patent Application No. Hei 2(1990)-279495 ('495), for example, teaches a steering system including a steering hydraulic cylinder attached to a swivel bracket. A piston rod of the hydraulic cylinder is extended and contracted to power-assist rudder turning through a tiller handle or the like. Since the steering system is integrated with the outboard motor, it minimizes increase in the number and weight of the constituent components and saves space.

In a hydraulic cylinder used for rudder turning, extension/contraction of the piston rod is generally controlled by on/off operating a control valve provided in an oil line of the hydraulic circuit and switching the rotation direction of the motor that drives the hydraulic pump.

There is also known a power tilt-trim system for regulating an outboard motor's tilt angle and trim angle. As set out in Japanese Laid-open Patent Application No. Hei 7(1995)-228296, for instance, this power tilt-trim system achieves light weight and compact size by utilizing the same hydraulic pump to supply hydraulic oil to both the hydraulic cylinder for regulating the tilt angle and the hydraulic cylinder for regulating the trim angle.

However, the steering system taught by '495 is disadvantageous from the aspect of saving space around the outboard motor because in some operating states of the hydraulic cylinder, the hydraulic cylinder projects from the outboard motor main unit. In addition, when two outboard motors are installed side by side in a dual motor configuration, the installation space must be enlarged by the amount of projection of the hydraulic cylinders so as to prevent interference between the outboard motors.

SUMMARY OF THE INVENTION

An object of the present invention is therefore to overcome the foregoing issues by providing an outboard motor steering system that improves steering feel, is simply configured to avoid increase in number of components and weight, and does cause a problem regarding space utilization.

An object of the present invention is therefore to overcome the foregoing issues by providing an outboard motor steering system that improves steering feel, is simply configured to avoid increase in number of components and weight, and does not cause a problem regarding space utilization.

Another object of the present invention is therefore to provide an outboard motor steering system that is configured in common with a hydraulic system for the power tilt-trim system to make it unnecessary to equip the steering system with a dedicated hydraulic pump and power source therefor, thereby enabling to reduce in size and weight.

In order to achieve the foregoing objects, this invention provides in a first aspect a steering system for an outboard motor mounted on a stem of a boat and having an internal combustion engine at its upper portion and a propeller with a rudder at its lower portion that is powered by the engine to propel the boat, comprising: a swivel shaft connected to the propeller to turn the propeller relative to the boat; and an electric motor installed inside the outboard motor and connected to the swivel shaft to rotate the swivel shaft such that the propeller is turned by rotation of the electric motor.

The invention provides in its second aspect a steering system for an outboard motor mounted on a stern of a boat and having an internal combustion engine at its upper portion and a propeller with a rudder at its lower part to be powered by the engine to propel the boat, comprising: a first hydraulic cylinder for swiveling the outboard motor to turn the propeller relative to the boat; a second hydraulic cylinder for tilting the outboard motor relative to the boat; a hydraulic pump for supplying hydraulic oil to the first hydraulic cylinder through a first oil path and to the second hydraulic cylinder through a second oil path; an electric motor connected to the hydraulic pump, the electric motor rotating in a direction to drive the hydraulic pump for supplying the hydraulic oil to the first and the second hydraulic cylinders; and hydraulic valves provided at the first and second oil paths to supply the hydraulic oil to the first and second hydraulic cylinders.

The invention provides in a third aspect a steering system for an outboard motor mounted on a stern of a boat and having an internal combustion engine at its upper portion and a propeller with a rudder at its lower portion that is powered by the engine to propel the boat, comprising: a hydraulic cylinder connected to the outboard motor at one end and to the boat at other end to swivel the outboard motor relative to the boat to turn the propeller; wherein the hydraulic cylinder is located inside a vertical projection plane of a profile of the outboard motor such that the hydraulic cylinder does not project outside the profile.

BRIEF DESCRIPTION OF THE DRAWINGS

The above and other objects and advantages of the invention will be more apparent from the following description and drawings, in which.

DETAILED DESCRIPTION OF THE PREFERRED EMBODIMENTS

An outboard motor steering system according to an embodiment of the present invention will now be explained with reference to the attached drawings.

Figure 1:
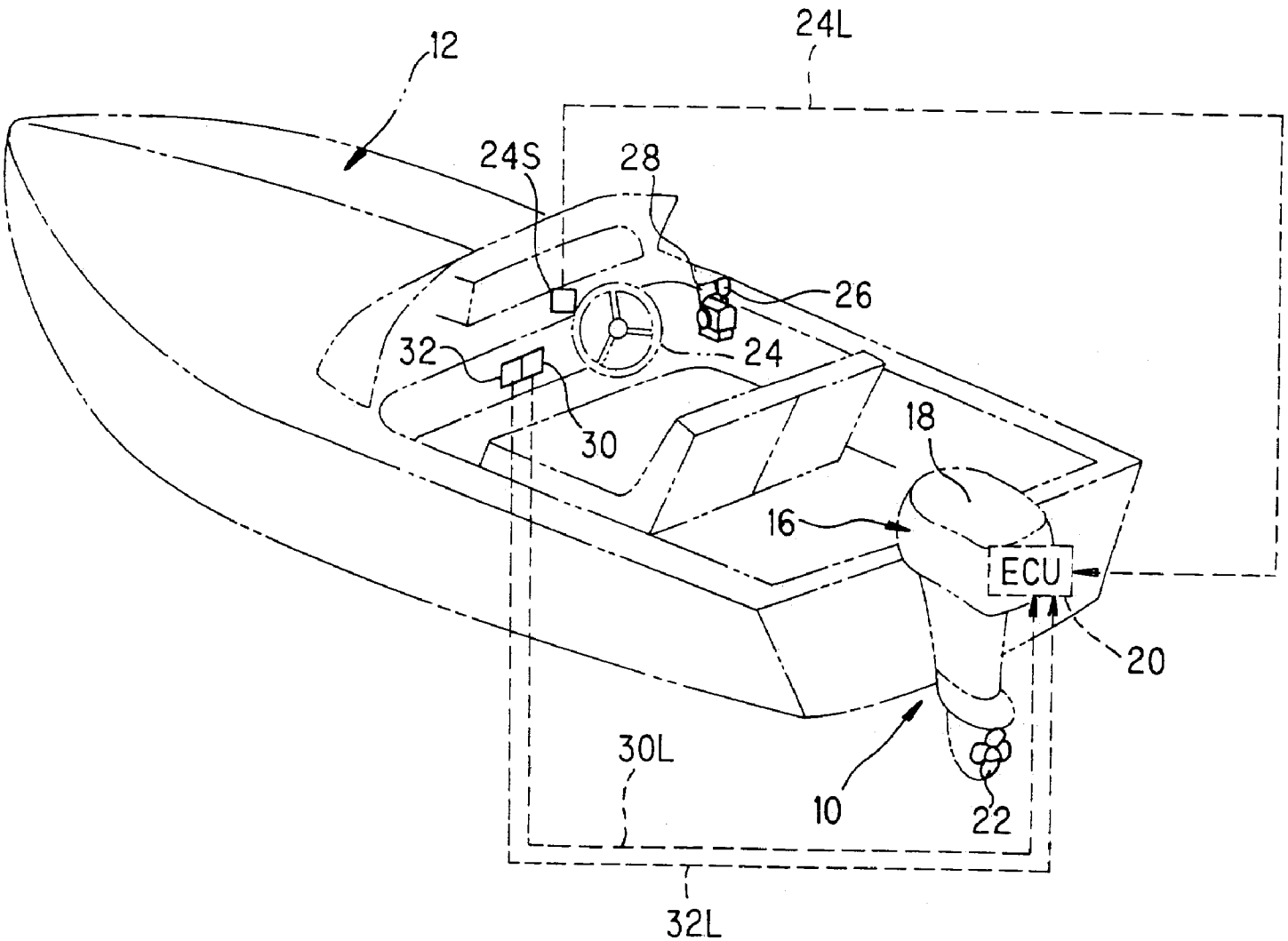
FIG. 1 is an overall schematic view of an outboard motor steering system according to an embodiment of the invention.
Figure 2:
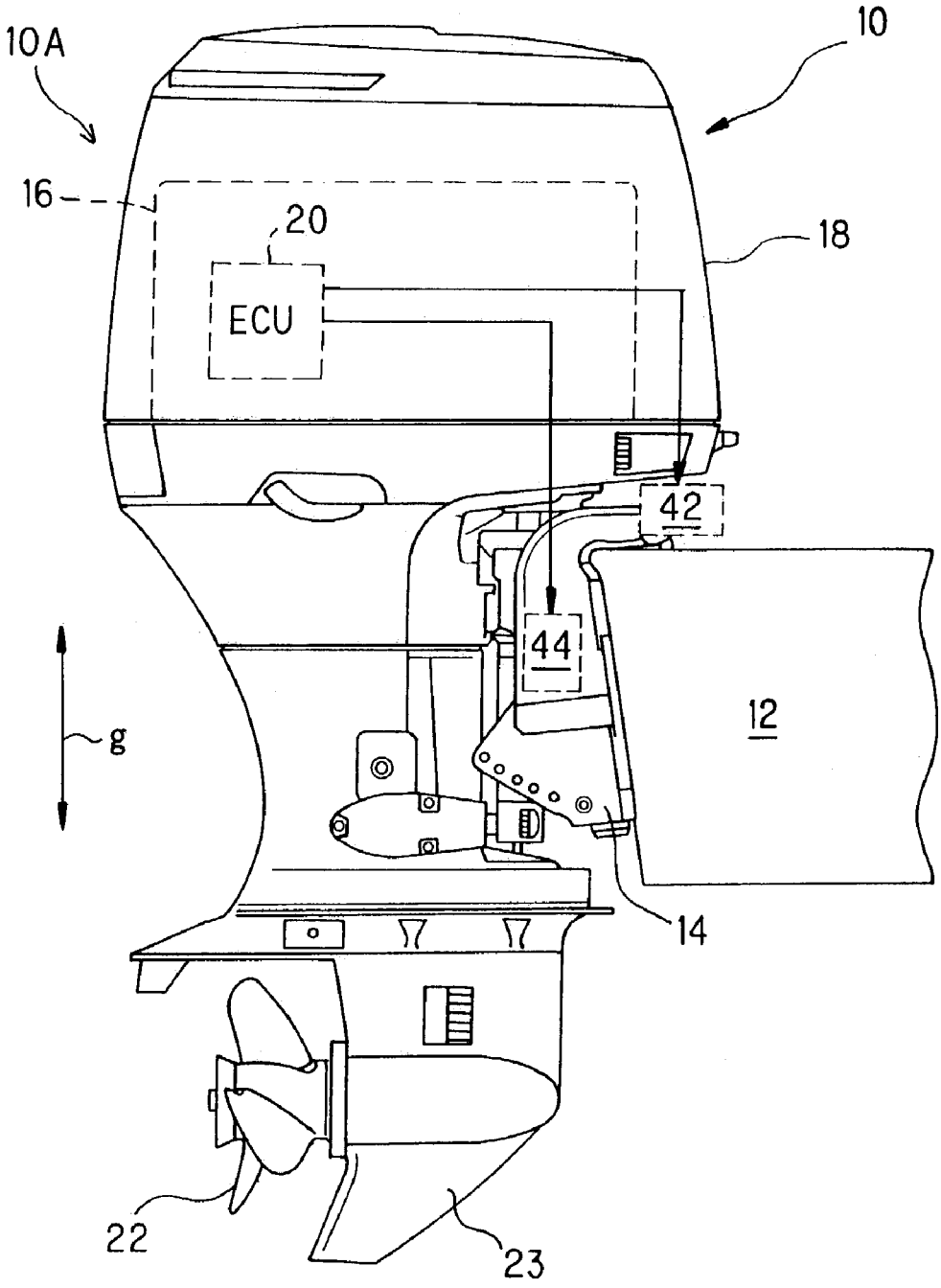
FIG. 2 is an explanatory side view of a part of FIG. 1.

FIG. 1 is an overall schematic view of the outboard motor steering system, and FIG. 2 is an explanatory side view of a part of FIG 1.

Reference numeral 10 in FIGS. 1 and 2 designates an outboard motor built integrally of an internal combustion engine, propeller shaft, propeller and other components. The outboard motor 10 is mounted on the stem of a hull (boat) 12 via stern brackets 14 (shown in FIG. 2).

As shown in FIG. 2, the outboard motor 10 is equipped with an internal combustion engine 16 at its upper portion (in the gravitational direction indicated by the arrow g). The engine 16 is a spark-ignition, in-line four-cylinder gasoline engine with a displacement of 2,200 cc. The engine 16, located inside the outboard motor 10, is enclosed by an engine cover 18 and positioned above the water surface. An electronic control unit (ECU) 20 constituted of a microcomputer is installed near the engine 16 enclosed by the engine cover 18.

The outboard motor 10 is equipped at its lower part with a propeller 22 and a rudder 23. The rudder 23 is fixed near the propeller 22 and does not rotate independently. The propeller 22, which operates to propel the boat 12 in the forward and reverse directions, is powered by the engine 16 through a crankshaft, drive shaft, gear mechanism and shift mechanism (none of which is shown).

As shown in FIG. 1, a steering wheel 24 is installed near the operator's seat of the boat 12. A steering angle sensor 24S installed near the steering wheel 24 outputs a signal in response to the turning of the steering wheel 24 by the operator. A throttle lever 26 and a shift lever 28 are mounted on the right side of the operator's seat. Operations input to these are transmitted to a throttle valve and the shift mechanism (neither shown) of the engine 16 through push-pull cables (not shown).

A power tilt switch 30 for regulating the tilt angle and a power trim switch 32 for regulating the trim angle of the outboard motor 10 are also installed near the operator's seat. These switches output signals in response to tilt up/down and trim up/down instructions input by the operator. The outputs of the steering angle sensor 24S, power tilt switch 30 and power trim switch 32 are sent to the ECU 20 over signal lines 24L, 30L and 32L.

In response to the output of the steering angle sensor 24S sent over the signal line 24L, the ECU 20 operates an electric motor 42 (shown in FIG. 2) to steer the outboard motor 10, i.e., change the direction of the propeller 22 and rudder 23, and thereby turn the boat 12 right or left.

In response to the outputs of the power tilt switch 30 and power trim switch 32 sent over the signal lines 30L, 32L, the ECU 20 operates a conventional power tilt-trim unit 44 to regulate the tilt angle and trim angle of the outboard motor 10.

Figure 3:
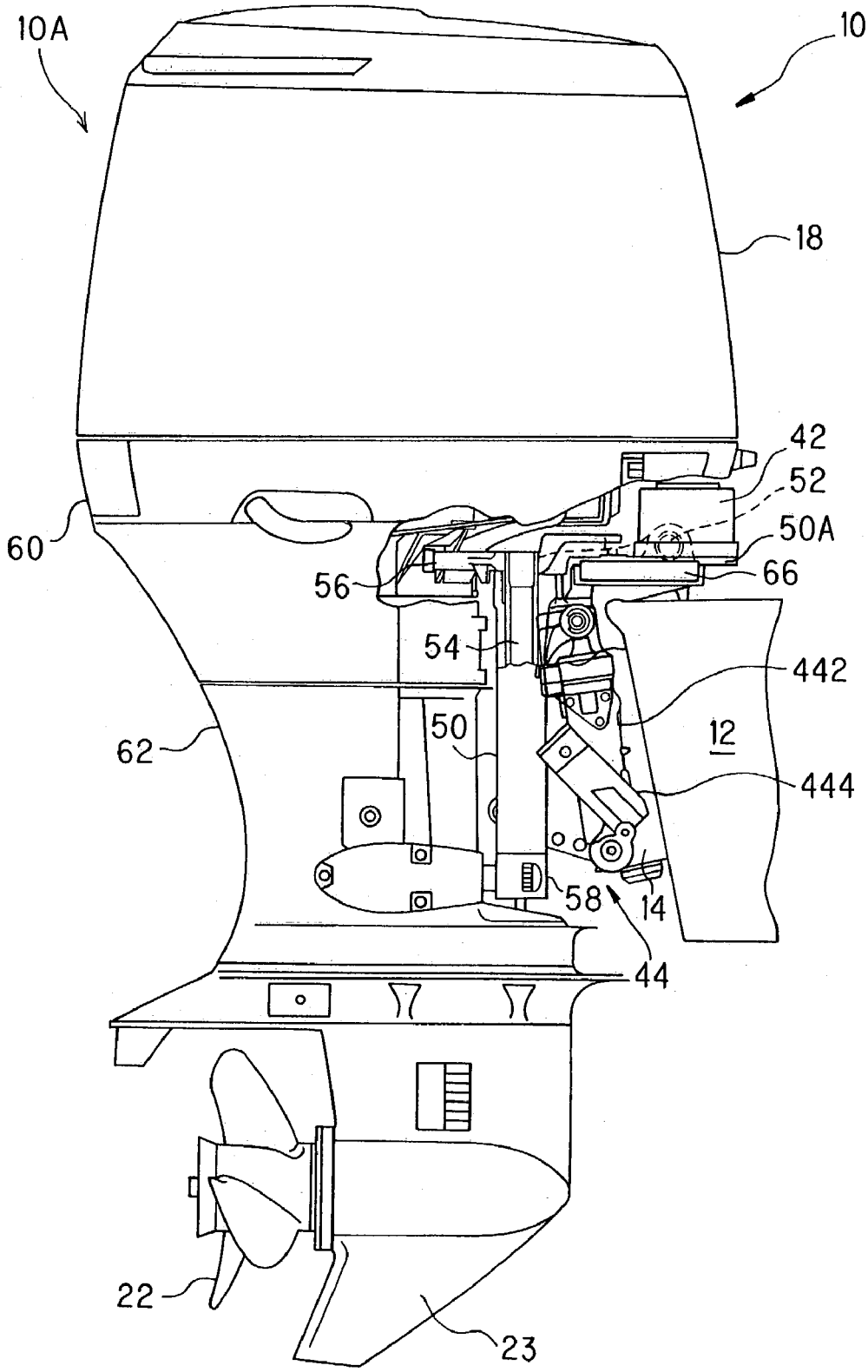
FIG. 3 is an enlarged explanatory side view of FIG. 2.

FIG. 3 is an enlarged explanatory side view. While this is basically an enlargement of FIG. 2, it should be noted that it is portrayed in a partially cutaway manner with the right side of the stem bracket 14 removed (the right side looking forward (toward the boat 12)).

As illustrated in FIG. 3, the power tilt-trim unit 44 is equipped with one hydraulic cylinder 442 for trim angle regulation (hereinafter called the "tilt hydraulic cylinder") and, constituted integrally therewith, two hydraulic cylinders 444 for trim angle regulation (hereinafter called the "trim hydraulic cylinders"; only one shown).

As shown in FIG. 3, one end of the tilt hydraulic cylinder 442 is fastened to the stern bracket 14 and through it to the boat 12 and the other end (piston rod) thereof is fastened to a swivel case 50. One end of each trim hydraulic cylinder 444 is fastened to the stem bracket 14 and through it to the boat 12, similarly to the one end of the tilt hydraulic cylinder 442, and the other end (piston rod) thereof abuts on the swivel case 50.

The swivel case 50 is connected to the stem bracket 14 through a tilting shaft 52 to be relatively displaceable about the tilting shaft 52. A swivel shaft 54 is rotatably accommodated inside the swivel case 50. The swivel shaft 54 has its upper end fastened to a mount frame 56 and its lower end fastened to a lower mount center housing 58. The mount frame 56 and lower mount center housing 58 are fastened to an under cover 60 and an extension case 62 (more exactly, to mounts covered by these members).

The electric motor 42 and a gearbox (gear mechanism) 66 for reducing the output of the electric motor 42 are fastened to an upper portion 50A of the swivel case 50.

Figure 4:
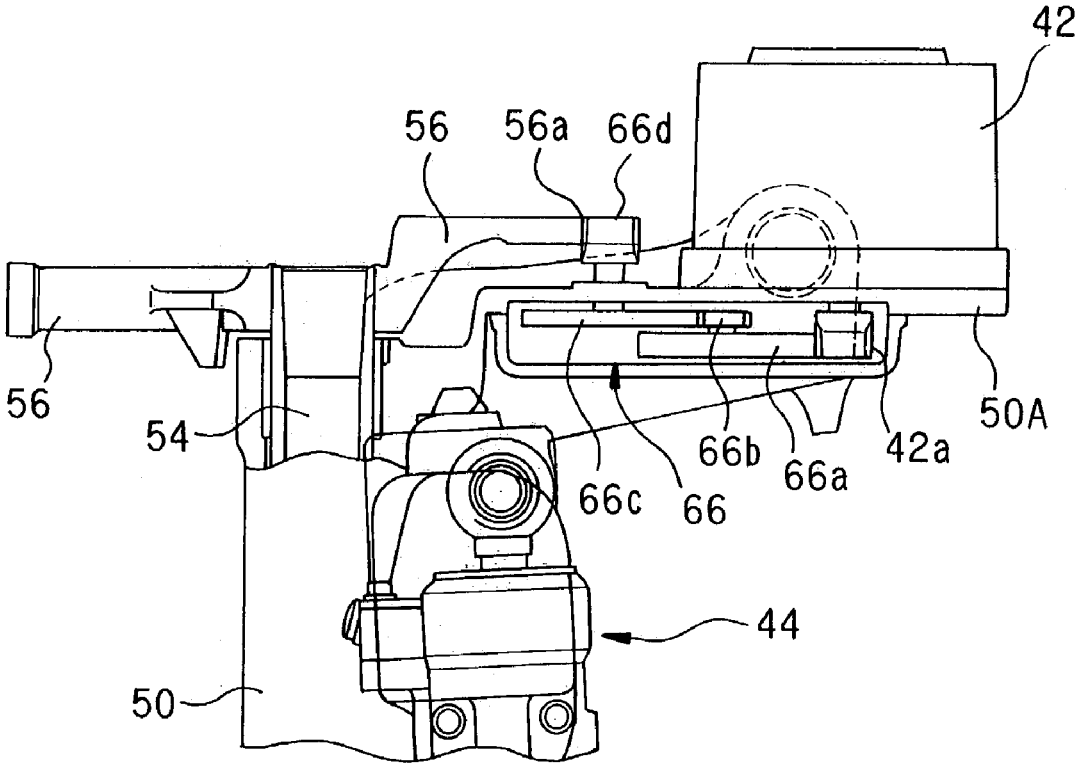
FIG. 4 is an enlarged partial side view of FIG. 3.
Figure 5:
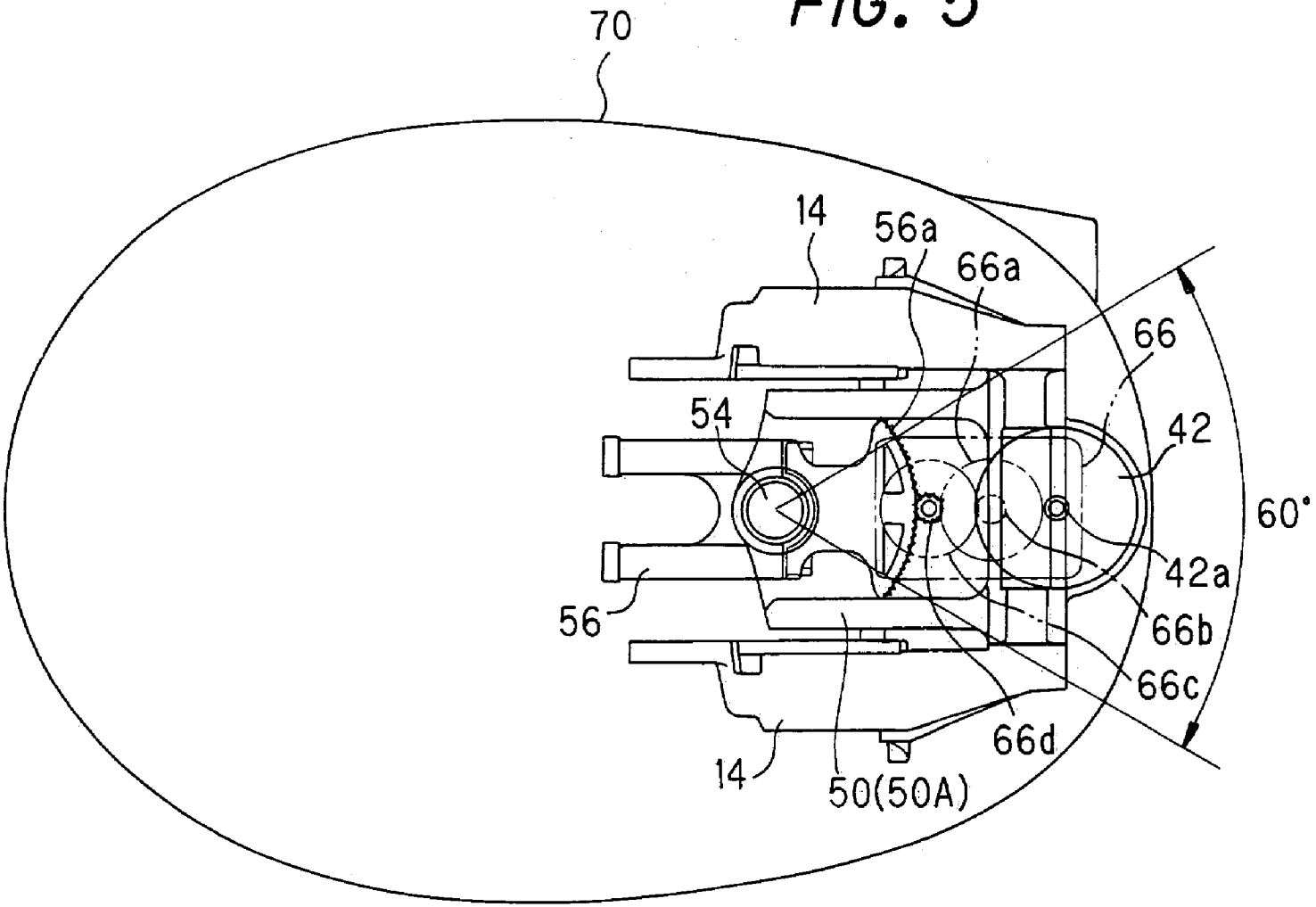
FIG. 5 is an explanatory view looking down from above (downward in the gravitational direction) showing an electric motor, a swivel case, a mount frame and a gearbox illustrated in FIG. 3.

FIG. 4 is an enlarged partial side view showing the vicinity of the swivel case 50. FIG. 5 is an explanatory view looking down from above (downward in the gravitational direction) showing the electric motor 42, swivel case 50, mount frame 56 and gearbox 66. Reference numeral 70 in FIG. 5 designates the vertical projection plane of the profile of the outboard motor main unit (designated by reference symbol 10A in FIGS. 1 and 2) in plan view.

In this specification, the term "outboard motor main unit" is used to refer collectively to all structures that swivel horizontally relative to the boat 12, including not only the engine 16, propeller 22 and rudder 23 but also the swivel shaft 54, mount frame 56, lower mount center housing 58 and the like. The outboard motor main unit 10A is thus defined not to include the stern bracket 14 and swivel case 50, which do not move angularly with respect to the boat 12.

Further, the outboard motor main unit 10A is driven together with the swivel case 50 by the extension/contraction actions of the tilt hydraulic cylinder 442 and the trim hydraulic cylinders 444 to move the tilt angle and trim angle up and down about the tilting shaft 52.

As shown best in FIGS. 4 and 5, the electric motor 42 is fixed to the swivel case 50 inside the outboard motor 10 (within the vertical projection plane 70 of the profile of the outboard motor main unit) and is connected to the mount frame 56 through the gearbox 66 similarly fixed inside the outboard motor 10.

Specifically, inside the gearbox 66, an output shaft gear 42*a* fastened on the output shaft of the electric motor 42 meshes with a first gear 66*a* of larger diameter (having more teeth) than the output shaft gear 42*a*.

A second gear 66*b* of smaller diameter (having fewer teeth) than the first gear 66*a* is fastened to the first gear 66*a* coaxially therewith, and the second gear 66*b* meshes with a third gear 66*c* of larger diameter. A fourth gear 66*d* of smaller diameter than the third gear 66*c* is fixed coaxially therewith outside the gearbox 66.

A mount frame gear 56*a* of larger diameter than the fourth gear 66*d* is formed on an arcuate end face of the mount frame 56. The fourth gear 66*d* meshes with the mount frame gear 56*a* to transmit the geared-down output of the electric motor 42 to the mount frame 56.

Horizontal steering of the outboard motor 10 is thus power-assisted using the rotational output of the electric motor 42 to swivel the mount frame 56 and thus steer the propeller 22 and rudder 23. The overall rudder turning angle of the outboard motor 10 is 60 degrees, 30 degrees to the left and 30 degrees to the right.

This use of the electric motor 42 installed inside the outboard motor 10 to steer (swivel) the outboard motor 10 improves the steering response, enables highly precise control, and offers enhanced steering feel. Moreover, owing to the fact that, differently from a hydraulic cylinder, the electric motor 42 undergoes no change in external shape with drive condition, it never projects outside the profile of the outboard motor main unit 10A regardless of the rudder angle of the outboard motor. Constriction of the space around the outboard motor 10 can therefore be avoided and the amount of required installation space can be reduced without causing interference between outboard motors when two outboard motors are installed side by side in a dual motor configuration.

Moreover, since the electric motor 42 is fastened to the upper portion 50A of the swivel case and operates through gears to steer the propeller 22 by rotating the mount frame 56 fastened to the swivel shaft 54, the electric motor (drive section) 42 and mount frame (steered section) 56 can be aligned on the same straight line. This enables further space-saving (particularly space-saving inside the outboard motor 10), prevents occurrence of excessive play, improves the steering response, and enhances steering feel.

An outboard motor steering system according to a second embodiment of the invention will now be explained with reference to FIGS. 6 and 7.

Figure 6:
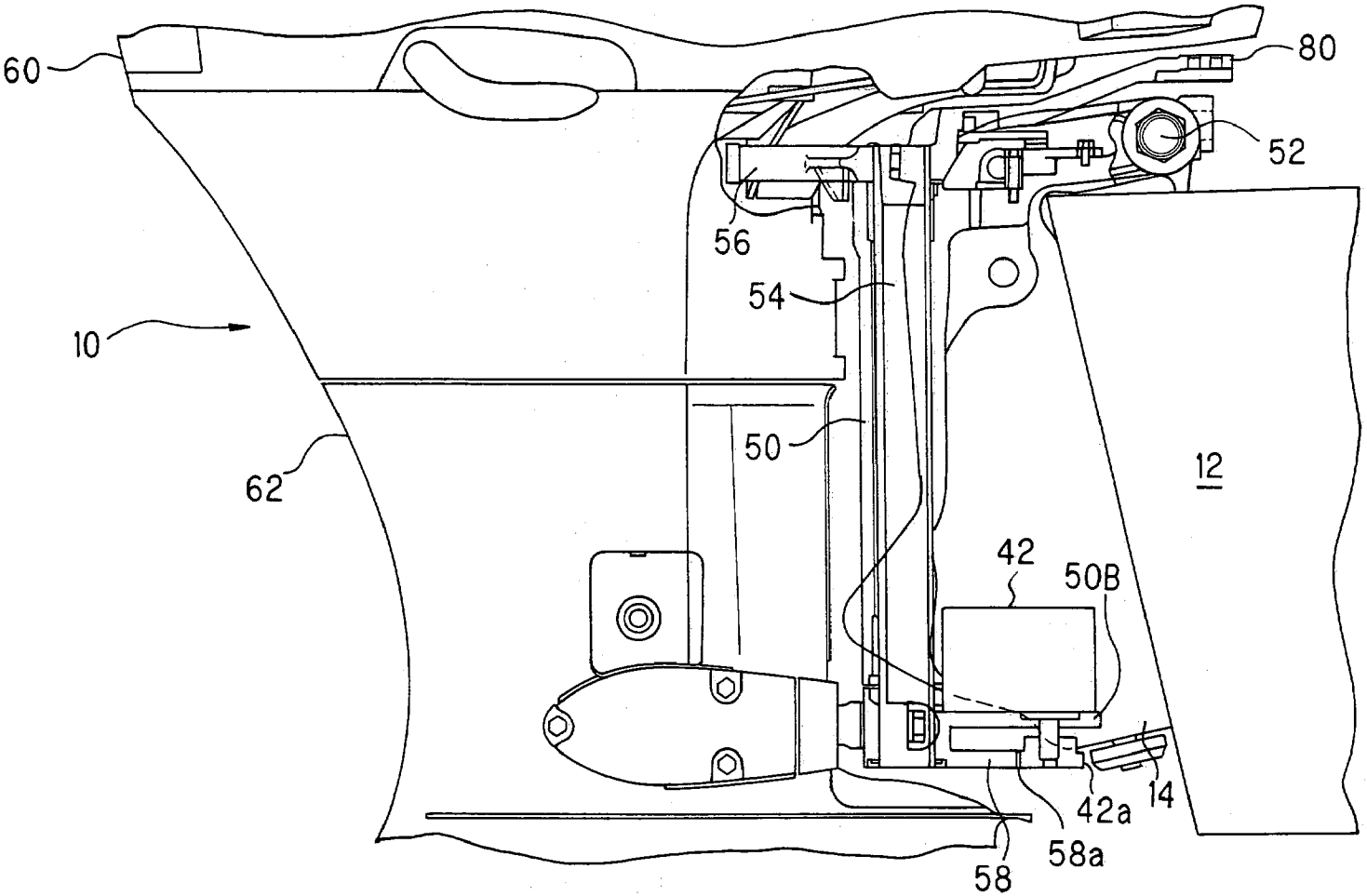
FIG. 6 is a partial explanatory side view showing an outboard motor steering system according to a second embodiment of the invention.
Figure 7:
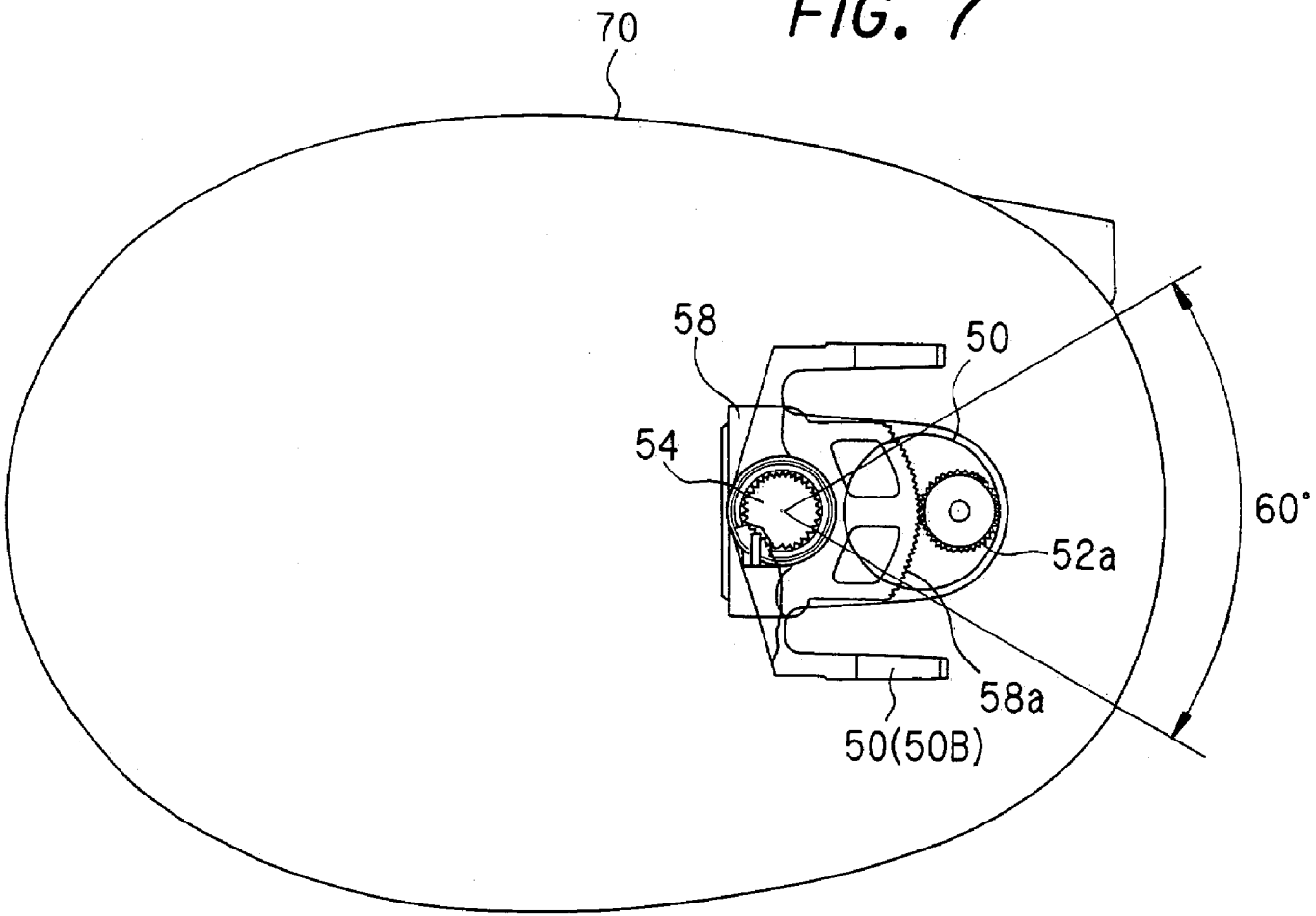
FIG. 7 is an explanatory view looking from below (looking upward in the gravitational direction) showing an electric motor, a swivel case and a lower mount center housing illustrated in FIG. 6.

FIG. 6 is a partial explanatory side view showing the outboard motor steering system according to the second embodiment. FIG. 7 is an explanatory view from below (looking upward in the gravitational direction) showing the electric motor 42, swivel case 50 and lower mount center housing 58. The power tilt-trim unit 44 is omitted from FIG. 6 for simplicity of illustration.

The points of difference from the embodiment set out in the foregoing will be explained. As shown in FIGS. 6 and 7, in this embodiment the electric motor 42 is fastened to a lower portion 50B of the swivel case 50 inside the outboard motor 10 (within the vertical projection plane 70 of the profile of the outboard motor main unit).

An output shaft gear 42*b* fastened on the output shaft of the electric motor 42 meshes directly with a larger-diameter lower mount center housing gear 58*a* formed on an arcuate end face of lower mount center housing 58 so that the output of the electric motor 42 is geared down and transmitted to the lower mount center housing 58.

Specifically, the rotational output of the electric motor 42 rotates the lower mount center housing 58 to power-assist the horizontal steering of the outboard motor 10 and thus steer the propeller 22 and rudder 23. As in the preceding embodiment, the overall rudder turning angle of the outboard motor 10 is again 60 degrees, 30 degrees to the left and 30 degrees to the right.

In the second embodiment, the use of the electric motor 42 installed inside the outboard motor 10 to steer (swivel) the outboard motor 10 improves the steering response, enables highly precise control, and offers enhanced steering feel. Moreover, owing to the fact that, differently from a hydraulic cylinder, the electric motor 42 undergoes no change in external shape with drive condition, it never projects outside the profile of the outboard motor main unit 10A regardless of the rudder angle of the outboard motor. Constriction of the space around the outboard motor 10 can therefore be avoided and the amount of required installation space can be reduced without causing interference between outboard motors when two outboard motors are installed side by side in a dual motor configuration.

Moreover, since the electric motor 42 is fastened to the lower portion 50B of the swivel case and operates through gears to steer the propeller 22 by rotating the lower mount center housing 58 fastened to the swivel shaft 54, the electric motor (drive section) 42 and the lower mount center housing (steered section) 58 can be aligned on the same straight line. This enables further space-saving (particularly space-saving inside the outboard motor 10), prevents occurrence of excessive play, improves the steering response, and enhances steering feel.

As shown in FIG. 6, a tiller handle 80 is provided on the mount frame 56 to enable manual steering. Steering is therefore possible even if the electric motor 42 should fail. The other aspects of second embodiment are not illustrated or explained here because they are the same as those of the first embodiment.

An outboard motor steering system according to a third embodiment of the invention will now be explained with reference to FIG. 8.

Figure 8:
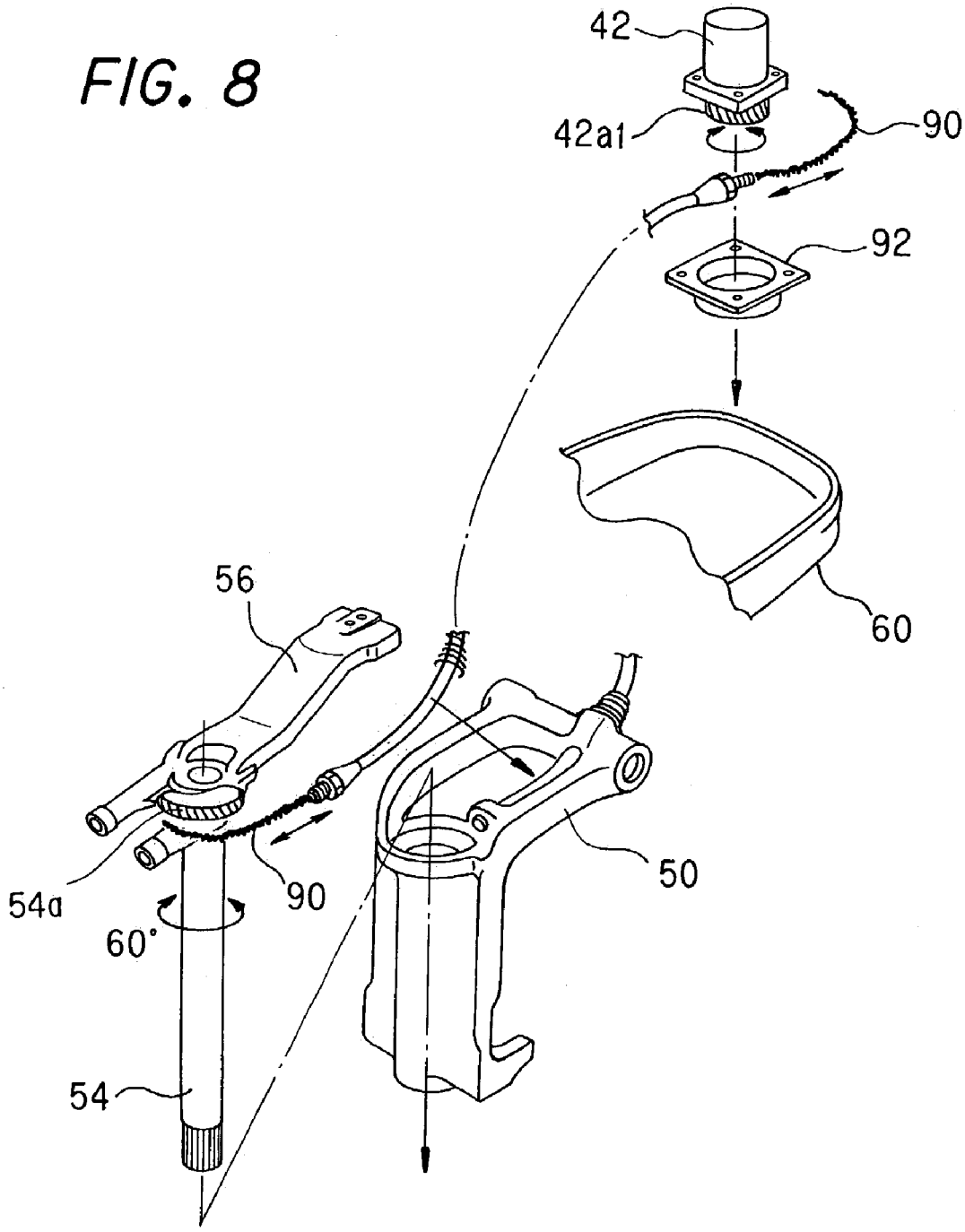
FIG. 8 is an explanatory perspective view showing an outboard motor steering system according to a third embodiment of the invention.

FIG. 8 is an explanatory perspective view showing the outboard motor steering system according to a third embodiment of the invention.

The points of difference from the embodiments set out in the foregoing will be explained. In this embodiment, as shown in FIG. 8, an output shaft reel gear 42*a*1 is fastened on the output shaft of the electric motor 42 and a swivel shaft reel gear 54*a* is fastened on the swivel shaft 54 near where it is joined to the mount frame 56.

A cable 90 equipped with a holder is wrapped around the output shaft reel gear 42*a*1 and swivel shaft reel gear 54*a* to interconnect them by meshing of the cable with the reel gears. The output of the electric motor 42 is transmitted to the swivel shaft 54 by pushing and pulling the cable 90.

Specifically, the rotational output of the electric motor 42 rotates the swivel shaft 54 by advancing and retracting the cable 90 so as to power-assist the horizontal steering of the outboard motor 10 and thus turn the propeller 22 and rudder 23. As in the preceding embodiments, the overall rudder turning angle of the outboard motor 10 is again 60 degrees, 30 degrees to the left and 30 degrees to the right.

Since the output shaft reel gear 42*a*1 and swivel shaft reel gear 54*a* are connected by the cable 90, the positional relationship between the electric motor (drive section) 42 and swivel shaft (steered section) 54 is not restricted. This permits the location for installing the electric motor 42 to be selected with greater freedom and makes it possible to mount the electric motor at a desired location inside the outboard motor. In this embodiment, therefore, the electric motor 42 is installed inside the under cover 60 using a reel gear housing 92 as a mount. This enables further space-saving and helps to protect the electric motor 42 against sea water, dust and the like.

The use of the electric motor 42 installed inside the outboard motor 10 (within the under cover 60 and thus inside the outboard motor 10) to steer (swivel) the outboard motor 10 improves the steering response, enables highly precise control, and offers enhanced steering feel. Moreover, owing to the fact that, differently from a hydraulic cylinder, the electric motor 42 undergoes no change in external shape with drive condition, it never projects outside the profile of the outboard motor main unit 10A regardless of the rudder angle of the outboard motor. Constriction of the space around the outboard motor 10 can therefore be avoided and the amount of required installation space can be reduced without causing interference between outboard motors when two outboard motors are installed side by side in a dual motor configuration.

Although not shown in the drawing, as in the second embodiment, a tiller handle 80 is provided on the mount frame 56 to enable manual steering. Steering is therefore possible even if the electric motor 42 should fail. The other aspects of third embodiment are not illustrated or explained here because they are the same as those of the first embodiment.

An outboard motor steering system according to a fourth embodiment of the present invention will now be explained with reference to FIGS. 9 to 19.

Figure 9:
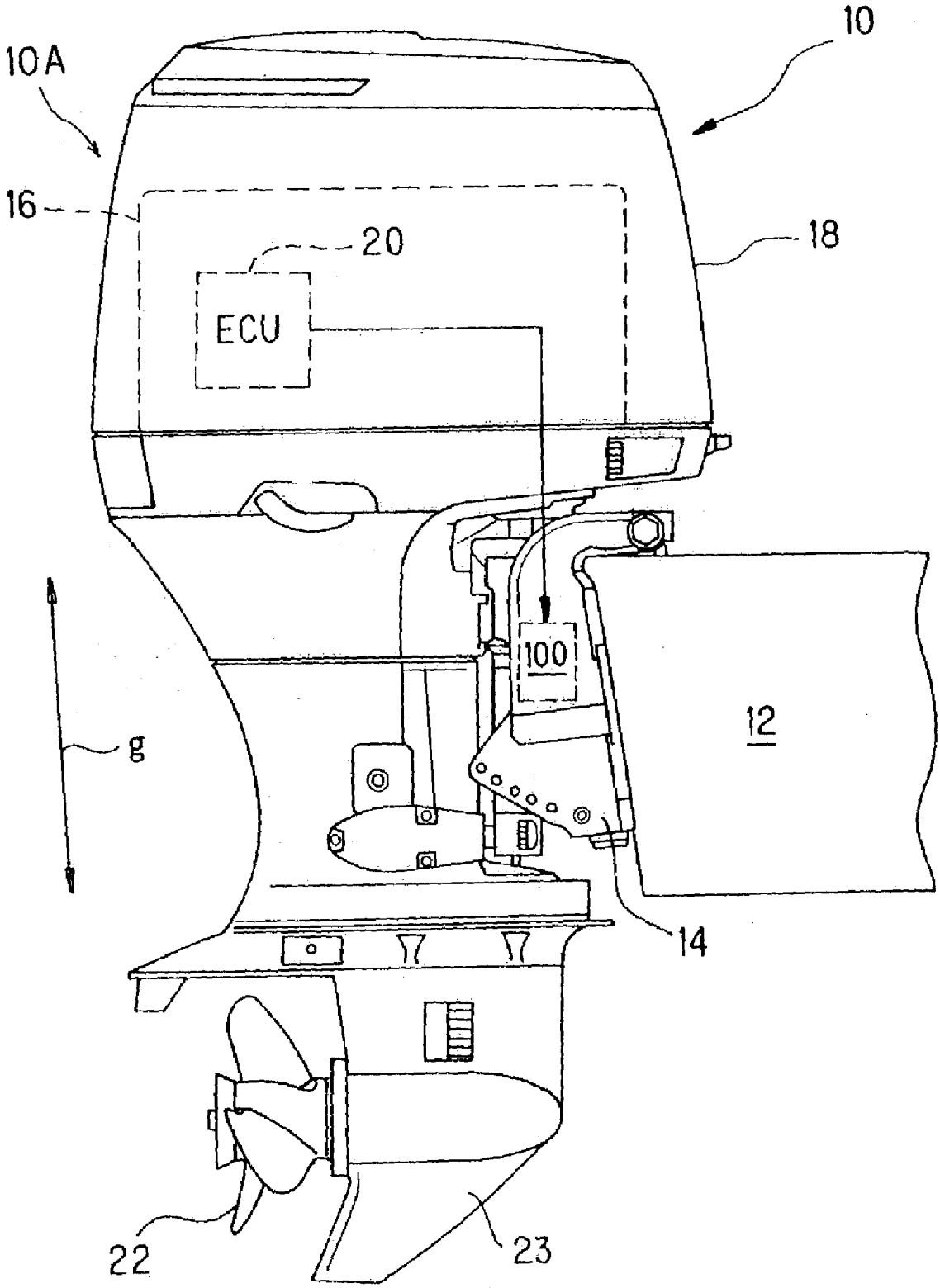
FIG. 9 is a partial explanatory side view, similar to FIG. 2, but showing an outboard motor steering system according to a fourth embodiment of the invention.

FIG. 9 is a partial explanatory side view similar to FIG. 2 showing the outboard motor steering system according to the fourth embodiment.

The points of difference from the embodiments set out in the foregoing will be explained. In this embodiment, the ECU 20 is configured to operate a hydraulic cylinder unit 100 in accordance with the output of the steering angle sensor 24S received via the signal line 24L and the outputs of the power tilt switch 30 and power trim switch 32 received via the signal lines 30L and 32L.

Figure 10:
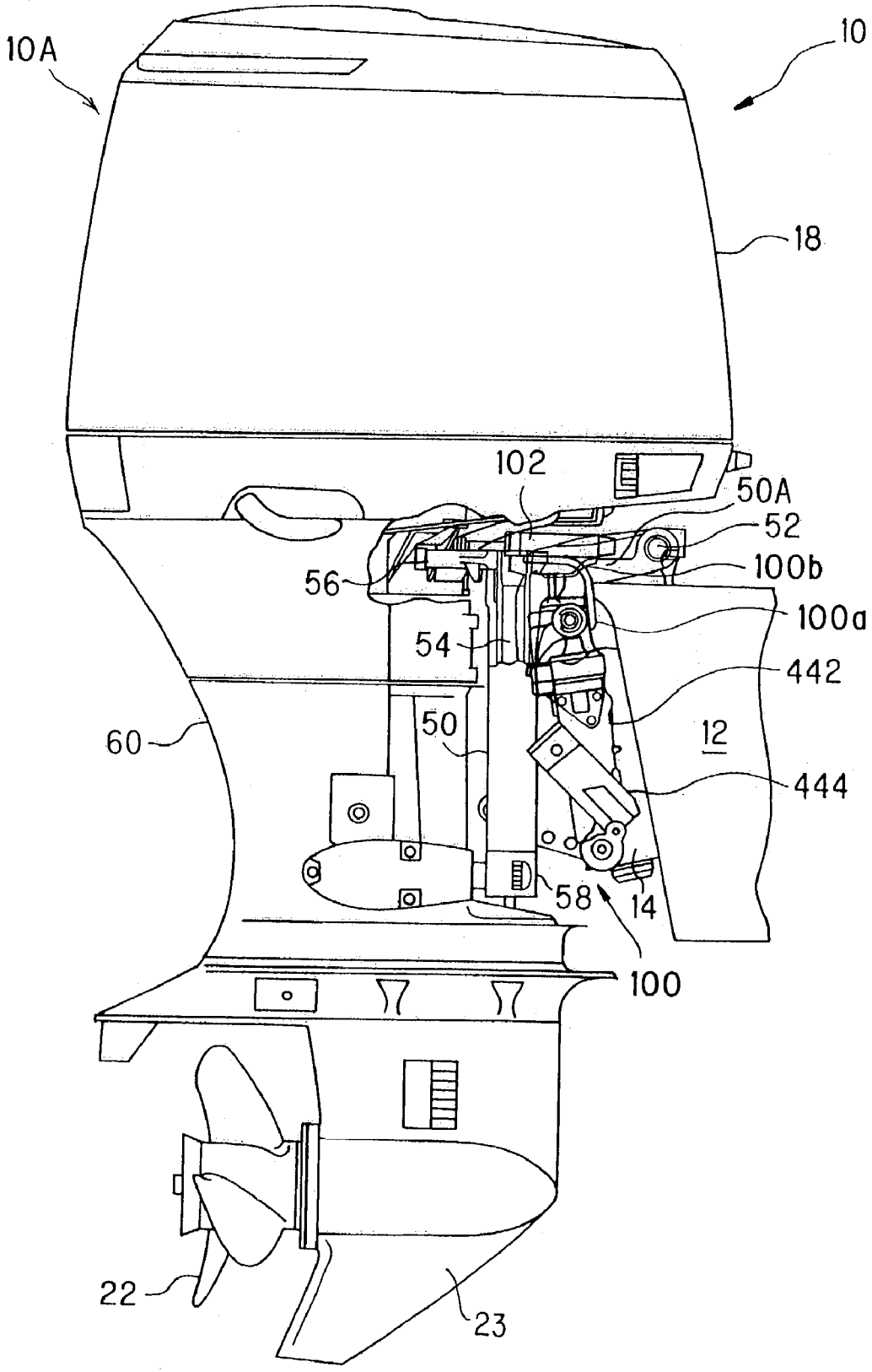
FIG. 10 is an enlarged explanatory side view of FIG. 9.
Figure 11:
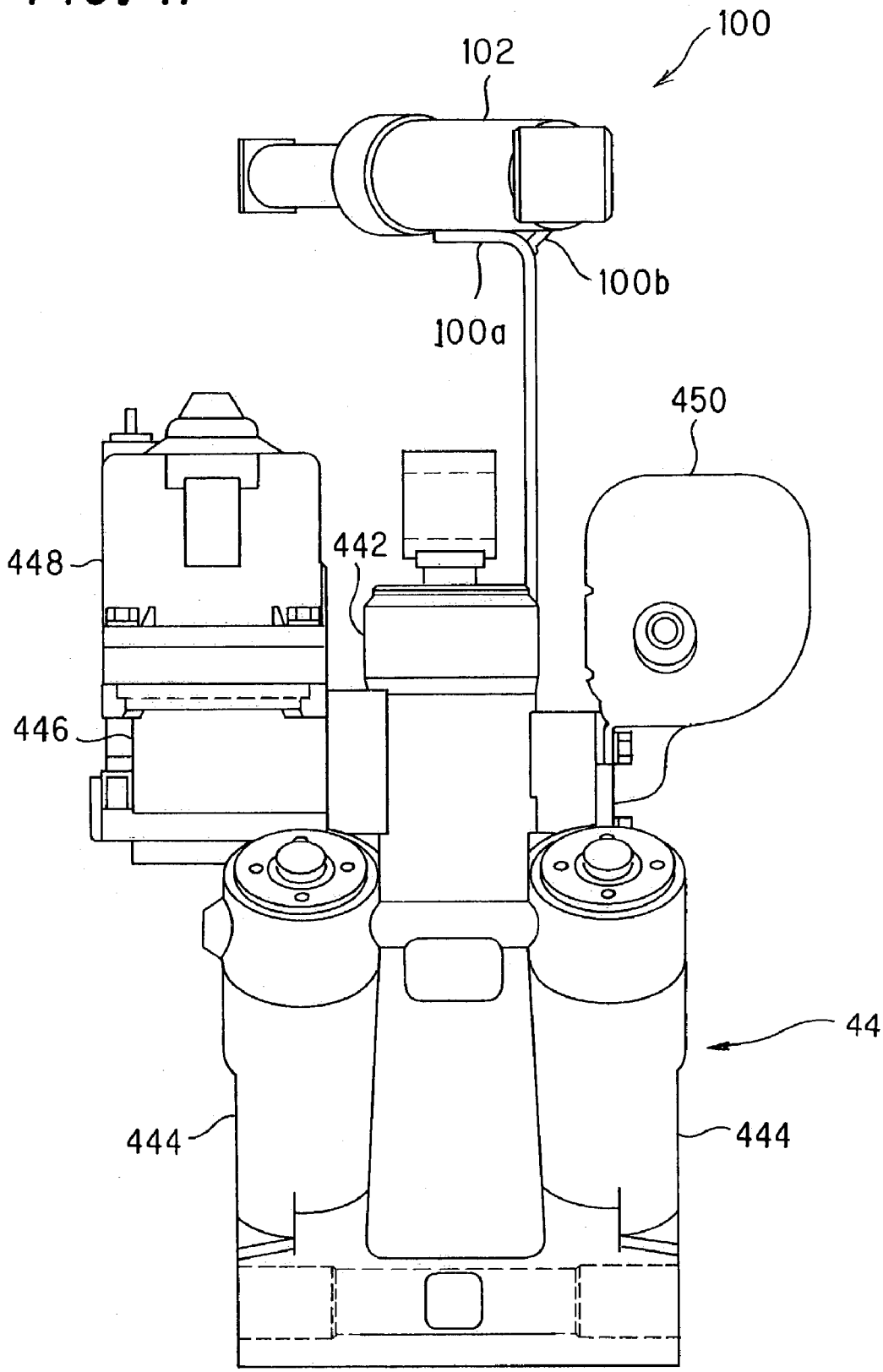
FIG. 11 is an enlarged front view of a hydraulic cylinder unit, illustrated in FIG. 10, seen from the side of the boat.

FIG. 10 is an enlargement of the explanatory side view of FIG. 9. FIG. 11 is an enlarged front view of the hydraulic cylinder unit 100 seen from the side of the boat 12.

As shown in FIGS. 10 and 11, the hydraulic cylinder unit 100 is integrally configured by interconnecting a steering hydraulic cylinder 102 and the aforesaid power tilt-trim unit 44 with oil lines 100*a* and 100*b*. For convenience of illustration, the steering hydraulic cylinder 102 and the power tilt-trim unit 44 are not shown in their exact positional relationship.

The power tilt-trim unit 44 is equipped with the aforesaid single tilt hydraulic cylinder 442 and two trim hydraulic cylinders 444 and further includes a hydraulic pump 446 for supplying hydraulic oil to these cylinders, an electric motor 448 for driving the hydraulic pump 446, and a tank 450 for storing hydraulic oil.

Figure 12:
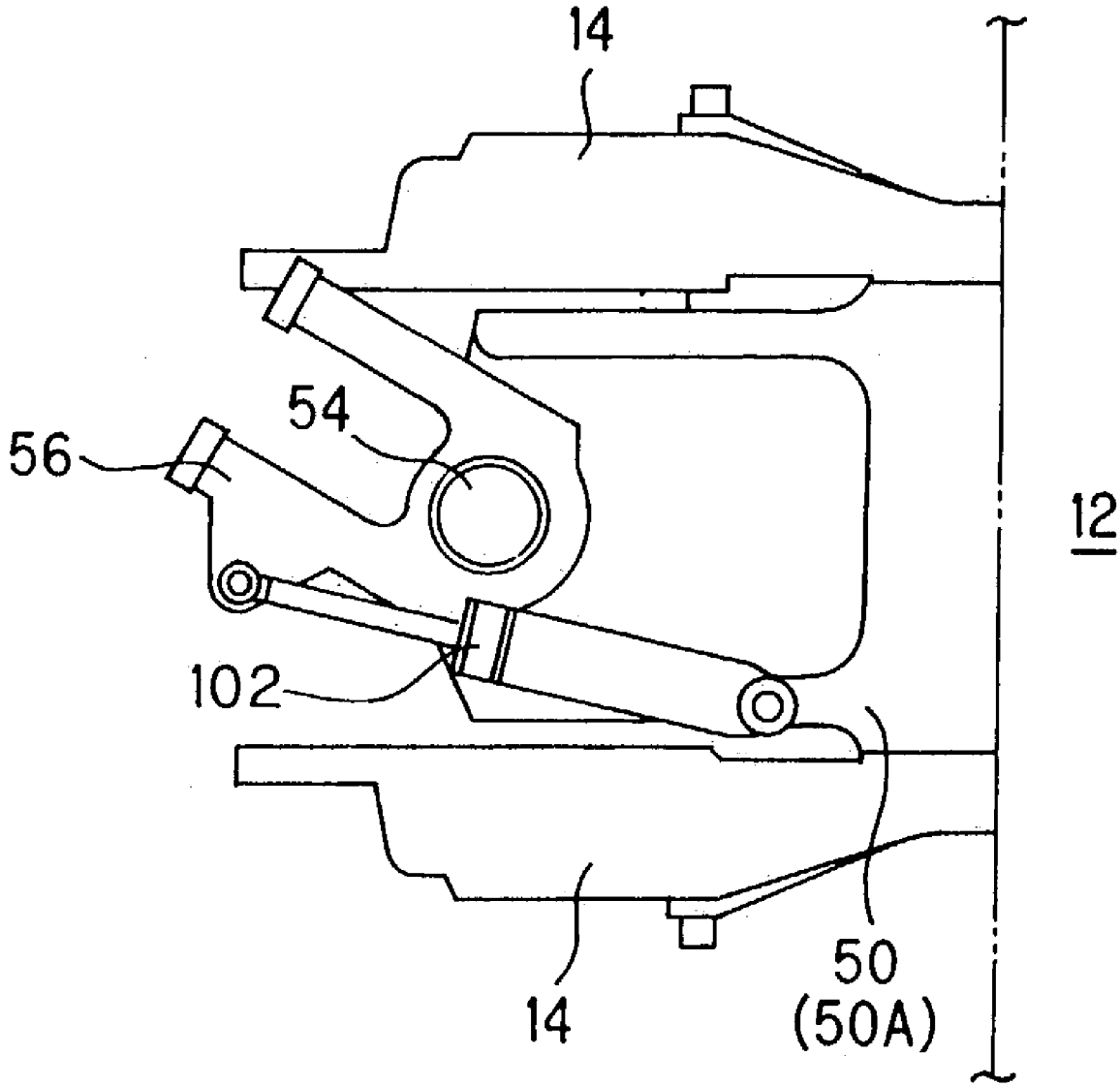
FIG. 12 is a plan view showing a steering hydraulic cylinder, a swivel case and a mount frame, illustrated in FIG. 10, as viewed from above in the gravitational direction.

FIG. 12 is a plan view showing the steering hydraulic cylinder 102, swivel case 50 and mount frame 56 as viewed from above in the gravitational direction. As shown in FIGS. 9 and 12, one end of the steering hydraulic cylinder 102 is fastened to the upper portion 50A of the swivel case 50 and the other end (piston rod) thereof is connected to the mount frame 56. The steering hydraulic cylinder 102 is shown in its fully extended state in FIG. 12.

Extension/contraction of the steering hydraulic cylinder 102 (i.e., movement of its piston rod) power-assists steering of the outboard motor main unit 10A in the horizontal direction to thereby steer the propeller 22 and rudder 23. Since the outboard motor main unit 10A is thus steered (swiveled) by the steering hydraulic cylinder 102 mounted on the outboard motor 10, the structure can be made simpler than when the steering system and outboard motor are constituted as separate units, without any increase in number of components or weight.

Figure 13:
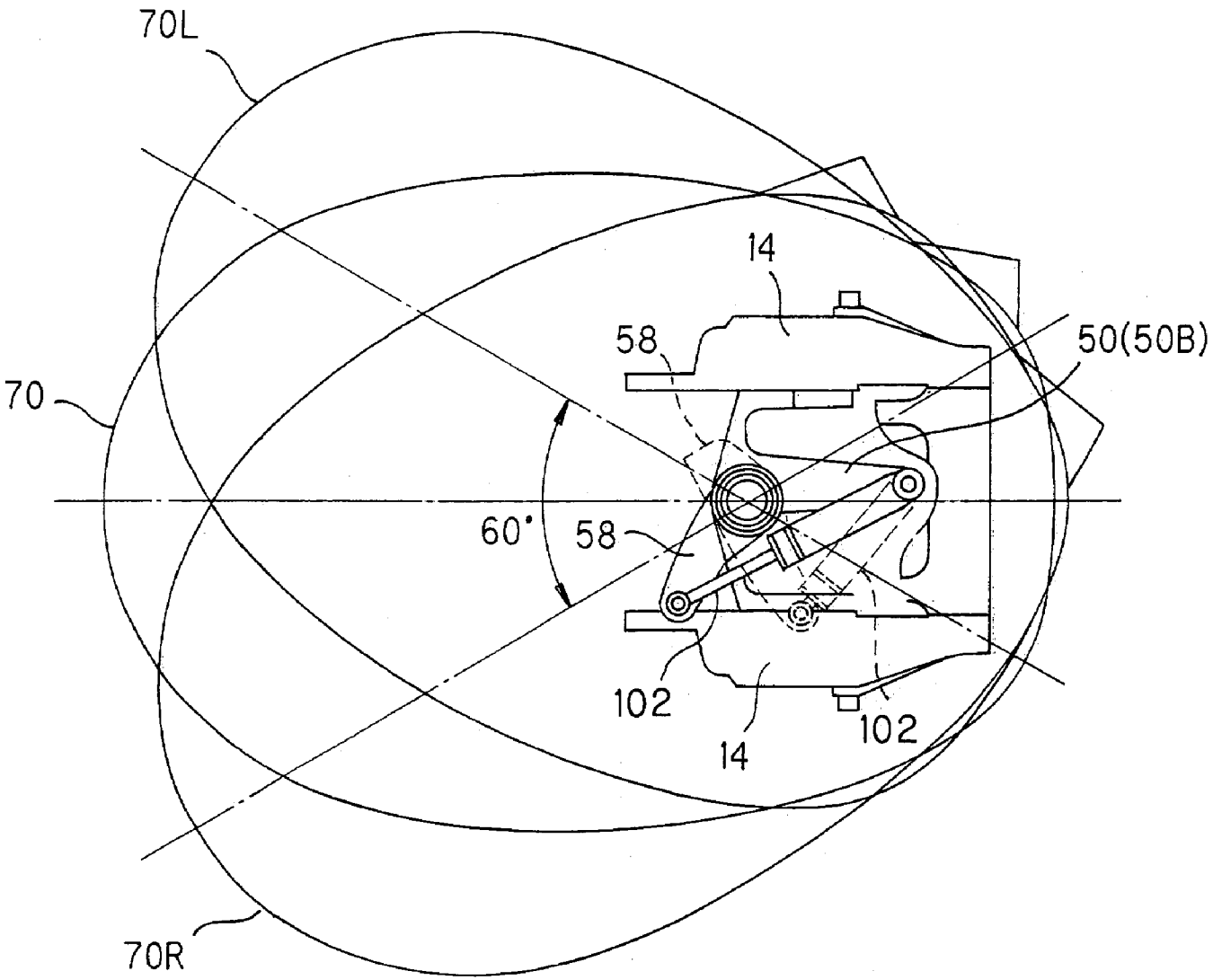
FIG. 13 is an explanatory view of the steering hydraulic cylinder, the swivel case and the mount frame, illustrated in FIG. 10, seen from above in the gravitational direction.

The steering hydraulic cylinder 102 will now be explained in detail with reference to FIG. 13. FIG. 13 is an explanatory view of the steering hydraulic cylinder 102, swivel case 50 and mount frame 56 seen from above in the gravitational direction.

In FIG. 13, the positions of the steering hydraulic cylinder 102 and mount frame 56 when the steering hydraulic cylinder 102 is fully extended and fully contracted are illustrated in solid and broken lines, respectively. Reference numeral 70 designates the vertical projection plane of the profile of the outboard motor main unit 10A in plan view when the rudder angle is zero. Reference symbol 70R designates the vertical projection plane when the steering hydraulic cylinder 102 is fully extended, i.e., when the outboard motor 10 is turned to the right limit (the boat 12 is turned left), and reference symbol 70L designates the vertical projection plane when the steering hydraulic cylinder 102 is fully contracted, i.e., when the outboard motor 10 is turned to the left limit (the boat 12 is turned right). The overall rudder turning angle of the outboard motor 10 is 60 degrees, 30 degrees to the right and 30 degrees to the left.

As illustrated, in a plan view taken in the gravitational direction, the steering hydraulic cylinder 102 is at all times located inside the vertical projection plane of the profile of the outboard motor main unit 10A irrespective of the outboard motor rudder angle. In other words, the steering hydraulic cylinder 102 never projects outside the profile of the outboard motor main unit 10A no matter how much it extends or contracts. Therefore, no constriction of the space around the outboard motor 10 occurs. Moreover, the amount of required installation space can be reduced without causing interference between outboard motors when two outboard motors are installed side by side in a dual motor configuration.

Moreover, one end of the steering hydraulic cylinder 102 is fastened to the upper portion 50A of the swivel case 50 and through it to the boat side (to a portion that experiences no angular displacement relative to the boat 12 when the outboard motor 10 is steered) and the other end (piston rod) is fastened to the mount frame 56 and through it to the outboard motor main unit 10A (to a portion that experiences angular displacement relative to the boat 12 when the outboard motor 10 is steered). In other words, the stationary member (swivel case) and steered member (mount frame) are directly connected by the steering hydraulic cylinder 102, without passing through the tiller handle or a link mechanism. This enables further space-saving, prevents occurrence of excessive play, improves the steering response, and enhances steering feel. In addition, the configuration is simple and therefore does not lead to an increase in number of components or weight.

The hydraulic circuit 100HC of the hydraulic cylinder unit 100 will now be explained with reference to FIGS. 14 to 19.

Figure 14:
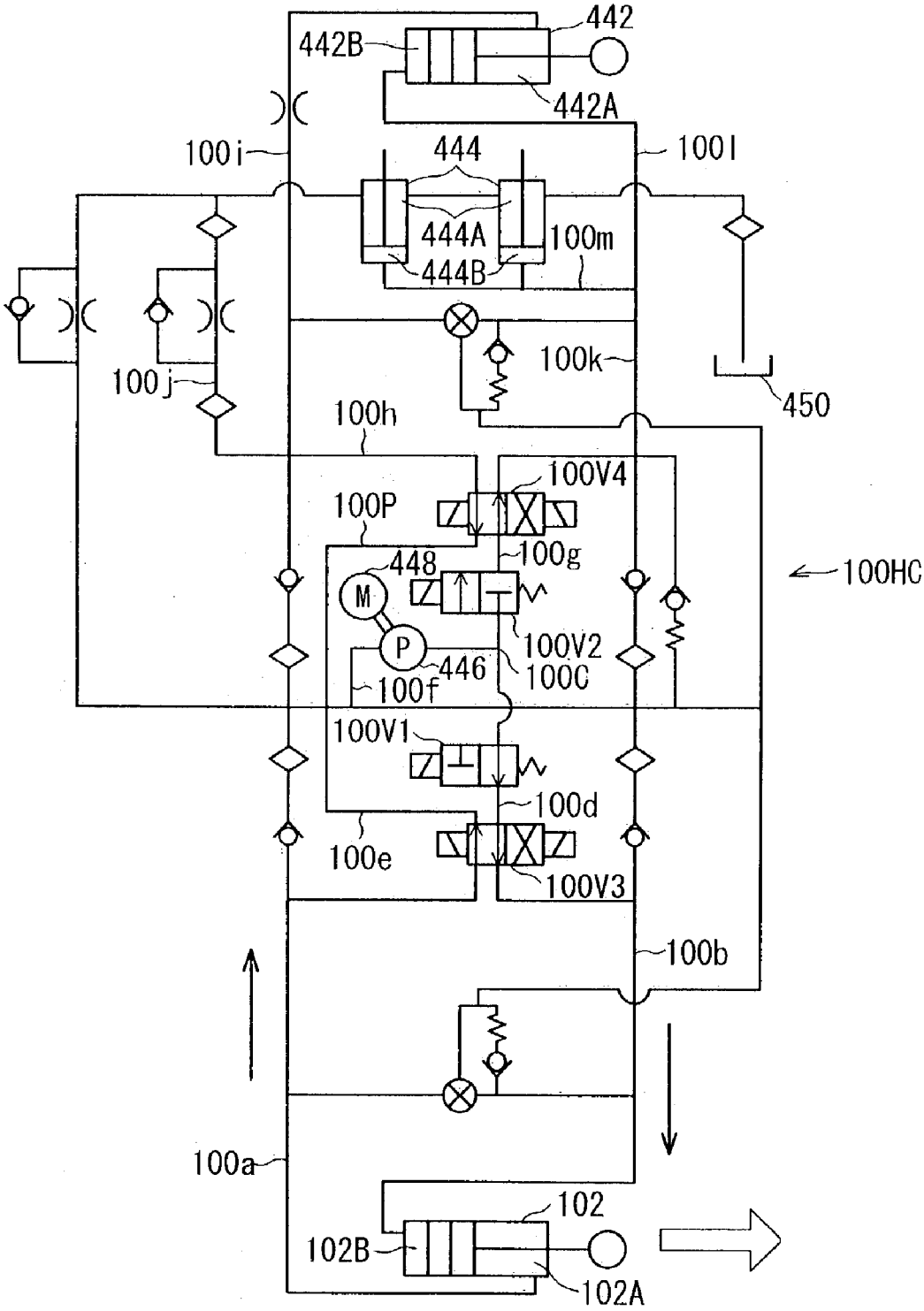
FIG. 14 is a hydraulic circuit diagram showing a hydraulic circuit of the hydraulic cylinder unit illustrated in FIG. 11.

As shown in FIG. 14, the hydraulic circuit 100HC incorporates the steering hydraulic cylinder 102, tilt hydraulic cylinder 442, two trim hydraulic cylinders 444, hydraulic pump 446, electric motor 448, and tank 450.

The hydraulic pump 446 is connected through an oil line 100*c* to a first ON-OFF control valve 100V1 and a second ON-OFF control valve 100V2, each equipped with a single magnetic solenoid. The first ON-OFF control valve 100V1 is connected through an oil line 100*d* to a first direction switching valve 100V3 equipped with two magnetic solenoids. The first direction switching valve 100V3 is connected through the oil line 100*a* to a first chamber 102A of the steering hydraulic cylinder 102 and through the oil line 100*b* to a second chamber 102B thereof. The first direction switching valve 100V3 is also connected through an oil line 100*e* and an oil line 100*f* to the hydraulic pump 446.

The second ON-OFF control valve 100V2 is connected through an oil line 100*g* to a second direction switching valve 100V4 equipped with two magnetic solenoids. The second direction switching valve 100V4 is connected to a first chamber 442A of the tilt hydraulic cylinder 442 through an oil line 100*h* and an oil line 100*i* communicating therewith and to first chambers 444A of the trim hydraulic cylinders 444 through the oil line 100*h* and an oil line 100*j* communicating therewith.

The second direction switching valve 100V4 is also connected to a second chamber 442B of the tilt hydraulic cylinder 442 through an oil line 100*k* and an oil line 100*l* communicating therewith and to second chambers 444B of the trim hydraulic cylinders 444 through the oil line 100*k* and an oil line 100*m* communicating therewith. The second direction switching valve 100V4 is further connected through an oil line 100*p* and the oil line 100*f* to the hydraulic pump 446. All oil lines other than the oil lines 100*a* and 100*b* and all valves of the hydraulic circuit 100HC are located inside the power tilt-trim unit 44.

The first and second ON-OFF control valves 100V1, 100V2 will now be explained briefly with reference to FIGS. 15A and 15B. Since the first and second ON-OFF control valves 100V1, 100V2 are structurally identical, explanation will be made only with respect to the first ON-OFF control valve 100V1.

Figure 15A:
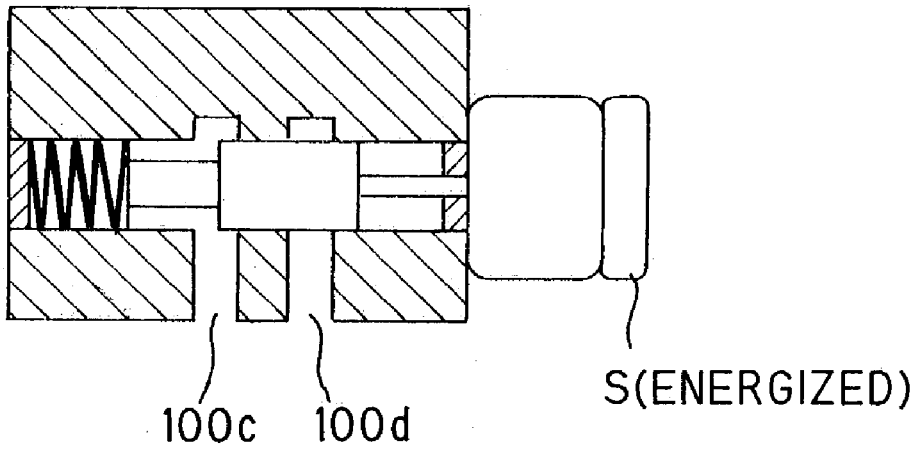
FIGS. 15A and 15B are a schematic showing first and second ON-OFF control valves illustrated in FIG. 14.
Figure 15B:
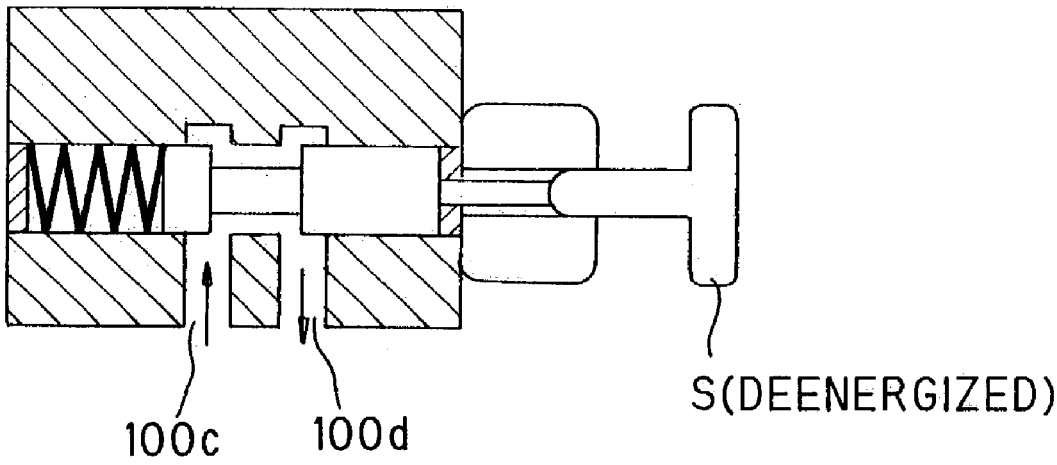

As shown in FIG. 15A, the first ON-OFF control valve 100V1 disconnects the oil line 100*c* from the oil line 100*d* when a magnetic solenoid S is energized. As shown in FIG. 15B, on the other hand, the first ON-OFF control valve 100V1 connects the oil line 100*c* with oil line 100*d* when the magnetic solenoid S is de-energized. Thus, the flow and cutoff of hydraulic oil is controlled by energizing/de-energizing the magnetic solenoid S of the first ON-OFF control valve 100V1. The magnetic solenoid S is energized/de-energized by current ON-OFF commands produced by the ECU 20 in accordance with the outputs of the steering angle sensor 24S, power tilt switch 30 and power trim switch 32.

Next, the first and second direction switching valves 100V3, 100V4 will be explained briefly with reference to FIGS. 16A and 16B. Since the first and second direction switching valves 100V3, 100V4 are structurally identical, explanation will be made only with respect to the first direction switching valve 100V3.

Figure 16A:
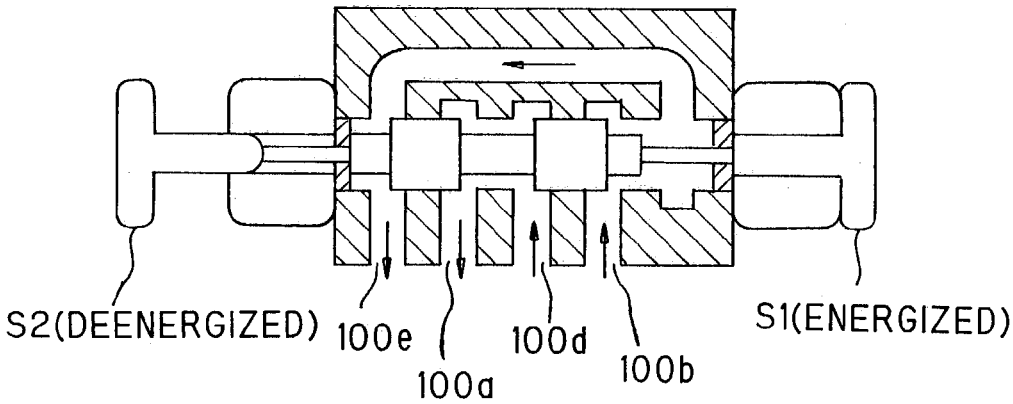
FIGS. 16A and 16B are a schematic showing first and second first and second direction switching valves illustrated in FIG. 14.
Figure 16B:
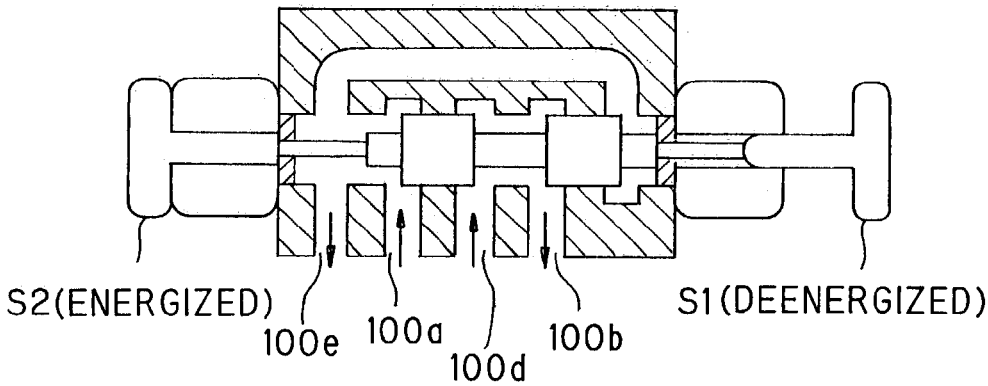

As shown in FIG. 16A, the first direction switching valve 100V3 connects the oil line 100*d* with the oil line 100*a* and connects the oil line 100*b* with the oil line 100*e* when a first magnetic solenoid S1 is energized and a second magnetic solenoid S2 is de-energized. As shown in FIG. 16B, on the other hand, the first direction switching valve 100V3 connects the oil line 100*a* with the oil line 100*e* and connects the oil line 100*d* with the oil line 100*b* when the first magnetic solenoid S1 is de-energized and the second magnetic solenoid S2 is energized. Thus, the direction of hydraulic oil flow is switched by energizing/de-energizing the first and second magnetic solenoids S1, S2 of the first direction switching valve 100V3. The first magnetic solenoids S1 and S1 are also energized/de-energized by current ON-OFF commands produced by the ECU 20 in accordance with the outputs of the steering angle sensor 24S etc.

The operation of the hydraulic circuit 100HC when the outboard motor 10 is turned right (during left turning of the boat 12 with the hydraulic cylinder 102 driven to extend) will now be explained with reference to FIG. 14.

When the outboard motor 10 is turned right, the magnetic solenoid S of the first ON-OFF control valve 100V1 is de-energized to connect the oil line 100*c* with the oil line 100*d*, and the magnetic solenoid S of the second ON-OFF control valve 100V2 is energized to disconnect the oil line 100*c* from the oil line 100*g*. Further, the first magnetic solenoid S1 of the first direction switching valve 100V3 is de-energized and the second magnetic solenoid S2 thereof is energized to connect the oil line 100*d* with the oil line 100*b* and the oil line 100*a* with the oil line 100*e*. Since the oil line 100*c* is disconnected from the oil line 100*g* by the second ON-OFF control valve 100V2, no hydraulic oil flows through the second direction switching valve 100V4 no matter which direction the oil path is switched.

As a result, hydraulic oil is supplied to the second chamber 102B of the steering hydraulic cylinder 102 by passing from the hydraulic pump 446 through the oil line 100*c*, first ON-OFF control valve 100V1, oil line 100*d*, first direction switching valve 100V3, and oil line 100*b*. In addition, hydraulic oil in the first chamber 102A of the steering hydraulic cylinder 102 passes through the oil line 100*a*, first direction switching valve 100V3, oil line 100*e* and oil line 100*f* to be sucked into the hydraulic pump 446.

The steering hydraulic cylinder 102 is therefore driven to extend and turn the outboard motor 10 right.

The electric motor 448 that drives the hydraulic pump 446 is operated by current ON-OFF commands produced by the ECU 20 in accordance with the outputs of the steering angle sensor 24S, power tilt switch 30 and power trim switch 32. It always rotates in the same direction irrespective of rudder turning direction or whether the tilt-trim is up or down. More specifically, the electric motor 448 rotates in the direction that enables the hydraulic pump 446 to constantly deliver hydraulic oil into the oil line 100*c*.

Figure 17:
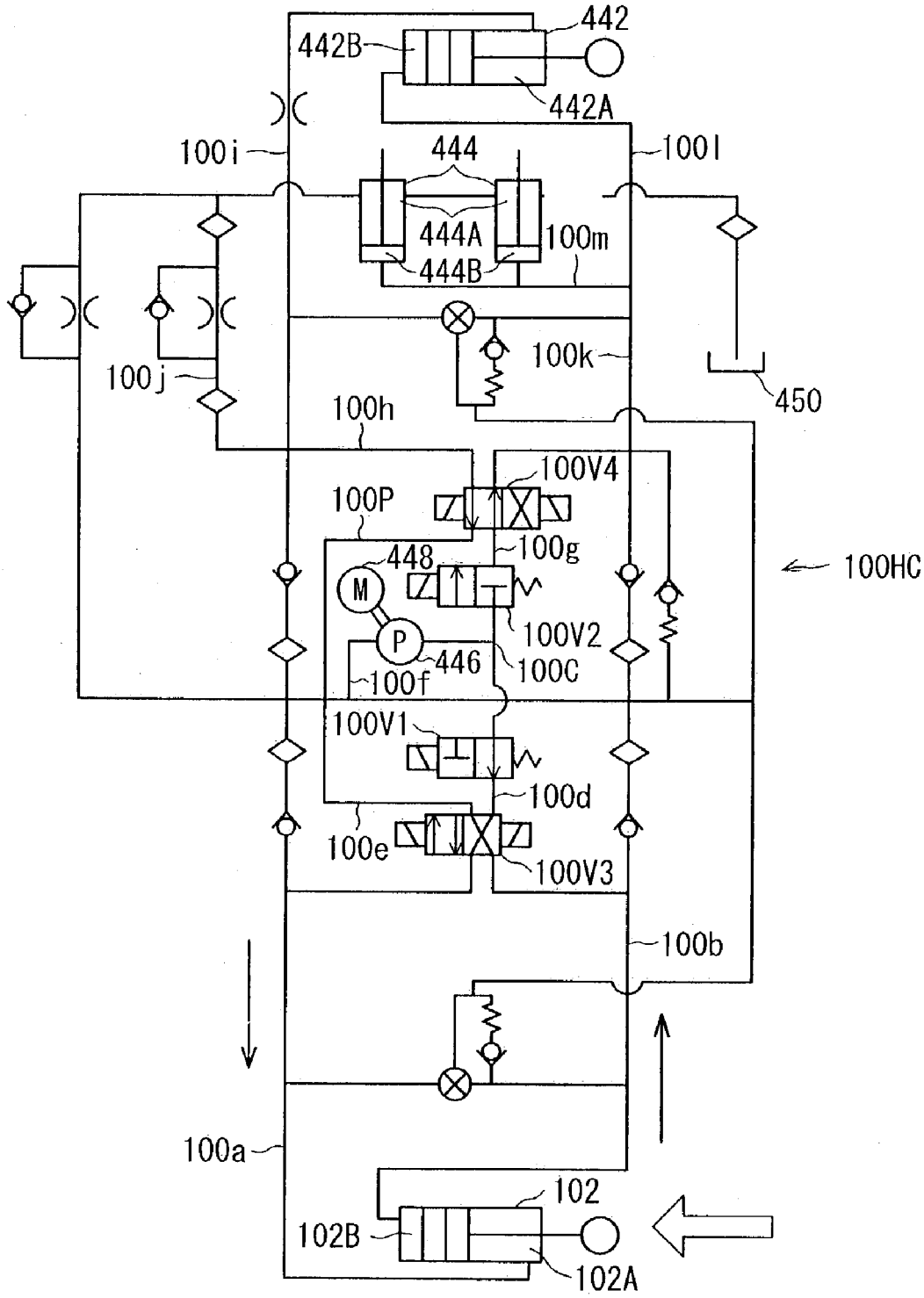
FIG. 17 is a hydraulic circuit diagram, similar to FIG. 14, but showing a hydraulic circuit of the hydraulic cylinder unit illustrated in FIG. 11.

The operation of the hydraulic circuit 100HC when the outboard motor 10 is turned left (during right turning of the boat 12 with the hydraulic cylinder 102 driven to contract) will now be explained with reference to FIG. 17.

When the outboard motor 10 is turned left, the magnetic solenoid S of the first ON-OFF control valve 100V1 is de-energized to connect the oil line 100*c* with the oil line 100*d*, and the magnetic solenoid S of the second ON-OFF control valve 100V2 is energized to disconnect the oil line 100*c* from the oil line 100*g*. Further, the first magnetic solenoid S1 of the first direction switching valve 100V3 is energized and the second magnetic solenoid S2 thereof is de-energized to connect the oil line 100*d* with the oil line 100*a* and the oil line 100*d* with the oil line 100*e*. Since the oil line 100*c* is disconnected from the oil line 100*g* by the second ON-OFF control valve 100V2, no hydraulic oil flows through the second direction switching valve 100V4 no matter which direction the oil path is switched.

As a result, hydraulic oil is supplied to the first chamber 102A of the steering hydraulic cylinder 102 by passing from the hydraulic pump 446 through the oil line 100*c*, first ON-OFF control valve 100V1, oil line 100*d*, first direction switching valve 100V3, and oil line 100*a*. In addition, hydraulic oil in the second chamber 102B of the steering hydraulic cylinder 102 passes through the oil line 100*b*, first direction switching valve 100V3, oil line 100*e*, and oil line 100*f* to be sucked into the hydraulic pump 446. The steering hydraulic cylinder 102 is therefore driven to contract and turn the outboard motor 10 left.

Figure 18:
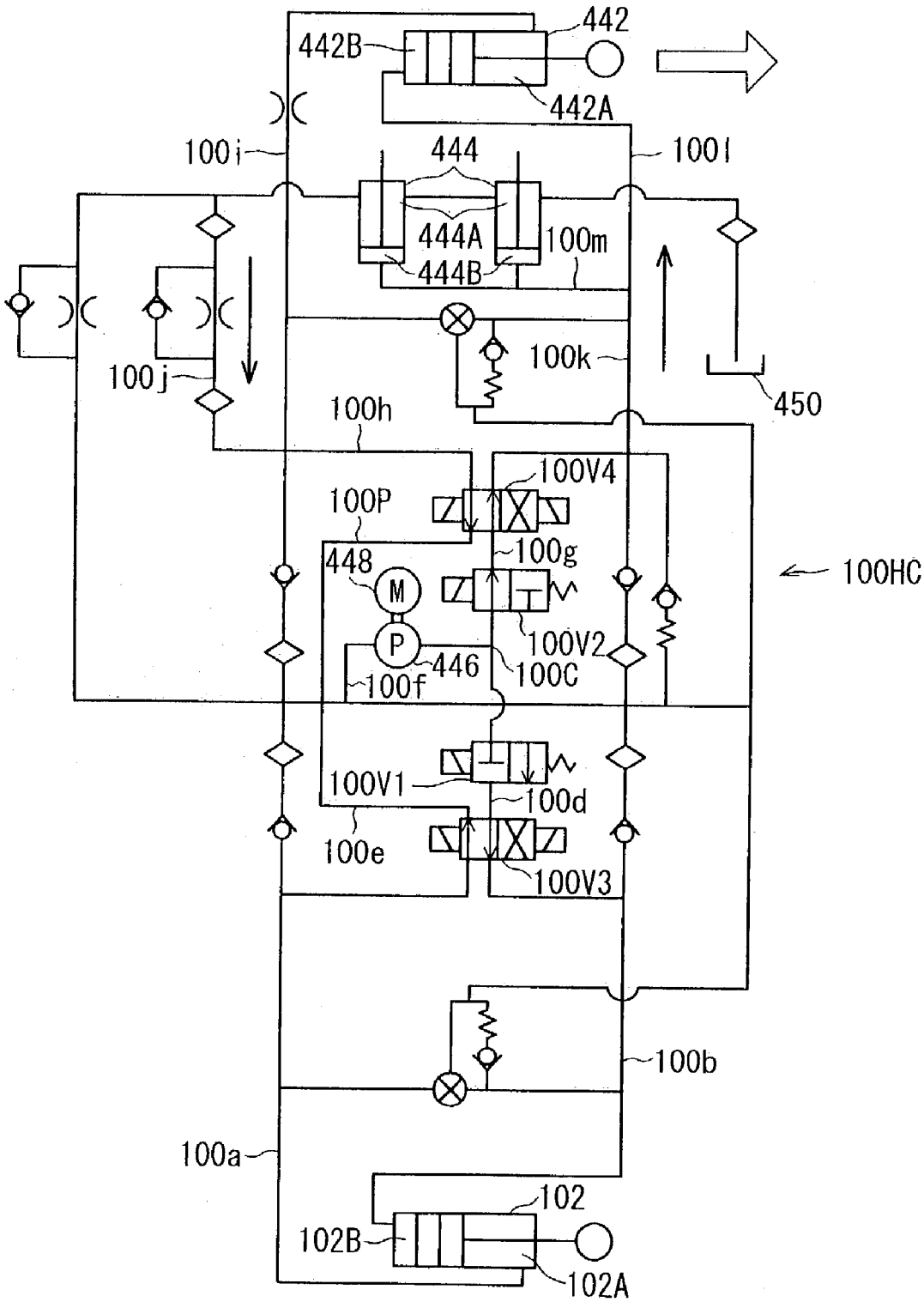
FIG. 18 is a hydraulic circuit diagram, similar to FIG. 14, but similarly showing a hydraulic circuit of the hydraulic cylinder unit illustrated in FIG. 11.

The operation of the hydraulic circuit 100HC when the outboard motor 10 is tilted and trimmed up will now be explained with reference to FIG. 18.

When the outboard motor 10 is tilted and trimmed up, the magnetic solenoid S of the first ON-OFF control valve 100V1 is energized to disconnect the oil line 100*c* from the oil line 100*d*, and the magnetic solenoid S of the second ON-OFF control valve 100V2 is de-energized to connect the oil line 100*c* with the oil line 100*g*. Further, the first magnetic solenoid SI of the second direction switching valve 100V4 is de-energized and the second magnetic solenoid S2 thereof is energized to connect the oil line 100*g* with the oil line 100*k* and the oil line 100*h* with the oil line 100*p*. Since the oil line 100*c* is disconnected from the oil line 100*d* by the first ON-OFF control valve 100V1, no hydraulic oil flows through the first direction switching valve 100V3 no matter which direction the oil path is switched.

As a result, hydraulic oil is supplied to the second chamber 442B of the tilt hydraulic cylinder 442 and to the second chambers 444B of the trim hydraulic cylinders 444 by passing from the hydraulic pump 446 through the oil line 100*c*, second ON-OFF control valve 100V2, oil line 100*g*, second direction switching valve 100V4, oil line 100*k*, and oil line 100*l* (and oil line 100*m*). In addition, hydraulic oil in the first chamber 442A of the tilt hydraulic cylinder 442 and in the first chambers 444A of the trim hydraulic cylinders 444 passes through the oil line 100*i* (and oil line 100*j*), oil line 100*h*, second direction switching valve 100V4, oil line 100*p*, and oil line 100*f* to be sucked into the hydraulic pump 446. The tilt hydraulic cylinder 442 and trim hydraulic cylinders 444 are therefore driven to extend and tilt-trim the outboard motor 10 up.

Figure 19:
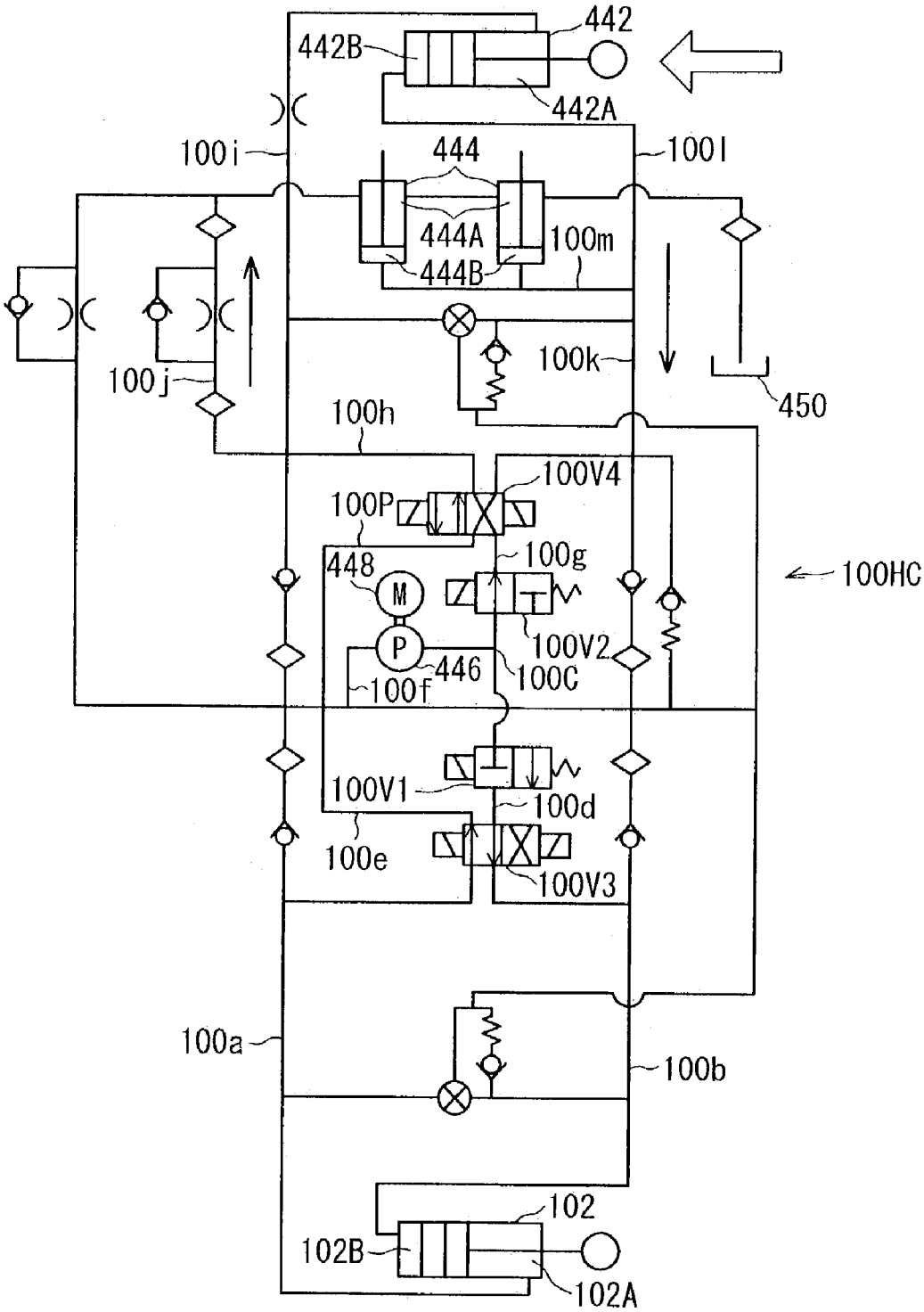
FIG. 19 is a hydraulic circuit diagram, similar to FIG. 14, but similarly showing a hydraulic circuit of the hydraulic cylinder unit illustrated in FIG. 11.

The operation of the hydraulic circuit 100HC when the outboard motor 10 is tilted and trimmed down will now be explained with reference to FIG. 19.

When the outboard motor 10 is tilted and trimmed down, the magnetic solenoid S of the first ON-OFF control valve 100V1 is energized to disconnect the oil line 100*c* from the oil line 100*d*, and the magnetic solenoid S of the second ON-OFF control valve 100V2 is de-energized to connect the oil line 100*c* with the oil line 100*g*. Further, the first magnetic solenoid S1 of the second direction switching valve 100V4 is energized and the second magnetic solenoid S2 thereof is de-energized to connect the oil line 100*g* with the oil line 100*h* and the oil line 100*k* with the oil line 100*p*. Since the oil line 100*c* is disconnected from the oil line 100*d* by the first ON-OFF control valve 100V1, no hydraulic oil flows through the first direction switching valve 100V3 no matter which direction the oil path is switched.

As a result, hydraulic oil is supplied to the first chamber 442A of the tilt hydraulic cylinder 442 and to the first chambers 444A of the trim hydraulic cylinders 444 by passing from the hydraulic pump 446 through the oil line 100*c*, second ON-OFF control valve 100V2, oil line 100*g*, second direction switching valve 100V4, oil line 100*h*, and oil line 100*i* (and oil line 100*j*). In addition, hydraulic oil in the second chamber 442B of the tilt hydraulic cylinder 442 and in the second chambers 444B of the trim hydraulic cylinders 444 passes through the oil line 100*l* (and oil line 100*m*), oil line 100*k*, second direction switching valve 100V4, oil line 100*p*, and oil line 100*f* to be sucked into the hydraulic pump 446. The tilt hydraulic cylinder 442 and trim hydraulic cylinders 444 are therefore driven to contract and tilt-trim the outboard motor 10 down.

The steering hydraulic cylinder 102, tilt hydraulic cylinder 442 and power tilt-trim unit 44 are thus supplied with hydraulic oil from the same hydraulic pump 446. In other words, an existing hydraulic pump and electric motor for supplying hydraulic oil to the hydraulic cylinders of a power tilt-trim system is further utilized to supply hydraulic oil to the hydraulic cylinder of a steering system, thereby making it unnecessary to provide a dedicated hydraulic pump and electric motor for the steering system. The size and weight of the system can therefore be reduced accordingly.

In addition, the electric motor 448 for driving the hydraulic pump 446 is made to rotate in only one direction and oil paths for operating the steering hydraulic cylinder 102 and for operating the tilt hydraulic cylinder 442 and trim hydraulic cylinders 444 are each provided with an ON-OFF control valve and direction switching valve. As a result, the steering system and the power tilt-trim system can be independently controlled without mutual interference. Thus, in addition to the aforesaid operations, it is further possible to operate the steering hydraulic cylinder 102 simultaneously with the tilt hydraulic cylinder 442 and trim hydraulic cylinders 444. For instance, the outboard motor 10 can be tilted up and trimmed up at the same time it is being turned to the right.

An outboard motor steering system according to a fifth embodiment of the present invention will now be explained with reference to FIGS. 20 to 22.

Figure 20:
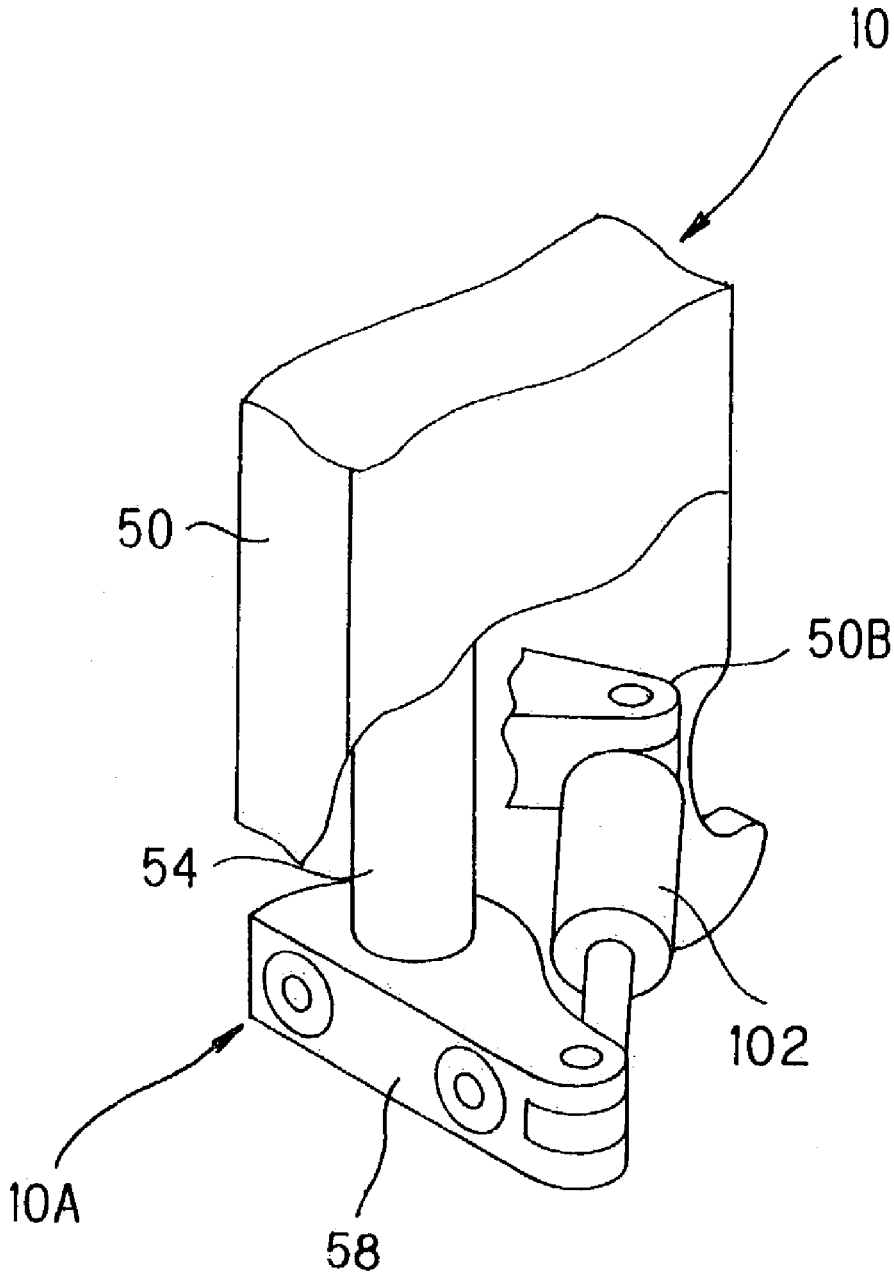
FIG. 20 is a partial explanatory perspective view showing an outboard motor steering system according to a fifth embodiment of the invention.
Figure 21:
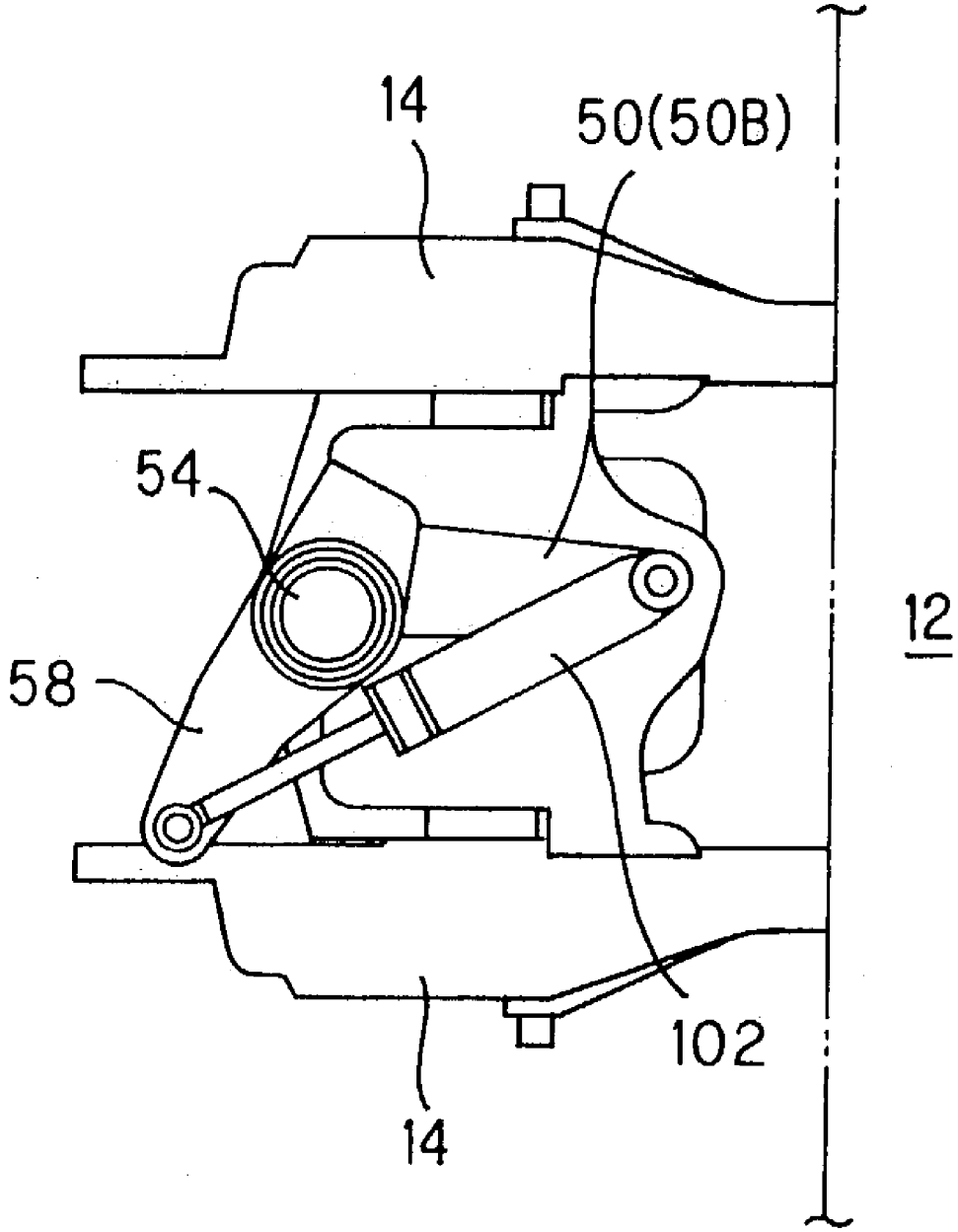
FIG. 21 is a plan view looking upward in the gravitational direction at the steering hydraulic cylinder, the swivel case and the lower mount center housing illustrated in FIG. 20.

FIG. 20 is a partial explanatory perspective view showing the outboard motor steering system according to the fifth embodiment. FIG. 21 is a plan view looking upward in the gravitational direction at the steering hydraulic cylinder 102, swivel case 50 and lower mount center housing 58. The points of difference from the embodiment set out in the foregoing will be explained. As shown in FIGS. 20 and 21, in this embodiment one end of the steering hydraulic cylinder 102 is fastened to the lower portion 50B of the swivel case 50 and the other end (piston rod) thereof is connected to the lower mount center housing 58. The steering hydraulic cylinder 102 is shown in its fully extended state in FIG. 21.

Figure 22:
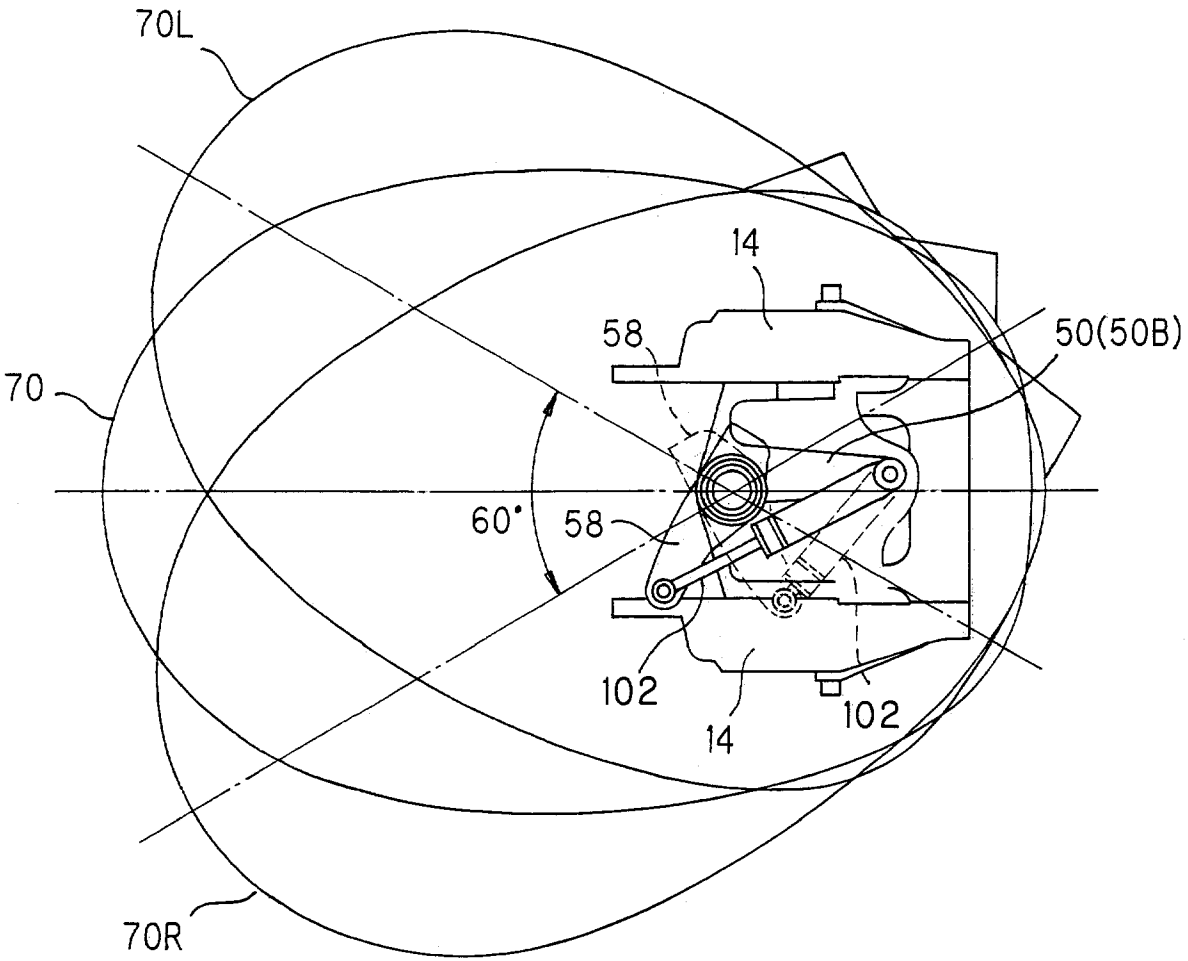
FIG. 22 is an explanatory view looking upward in the gravitational direction at the steering hydraulic cylinder, the swivel case and the lower mount center housing in the same manner as FIG. 21.
Figure 23:
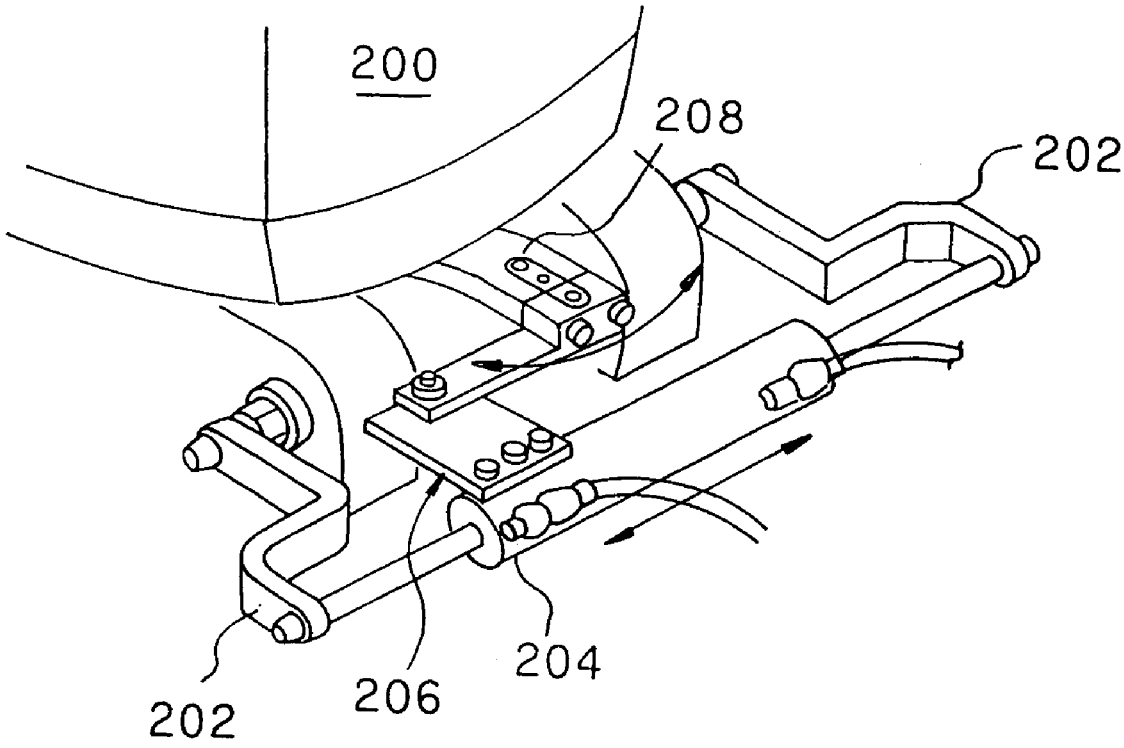
PRIOR ART FIG. 23
FIG. 23 is an explanatory view showing a prior art outboard motor steering system.

As illustrated in FIG. 22, in a plan view taken in the gravitational direction, the steering hydraulic cylinder 102 is at all times located inside the vertical projection plane of the profile of the outboard motor main unit 10A irrespective of the outboard motor rudder angle. In other words, the steering hydraulic cylinder 102 never projects outside the profile of the outboard motor main unit 10A no matter how much it extends or contracts. Therefore, no constriction of the space around the outboard motor 10 occurs. Moreover, the amount of required installation space can be reduced without causing interference between outboard motors when two outboard motors are installed side by side in a dual motor configuration.

Moreover, one end of the steering hydraulic cylinder 102 is fastened to the lower portion 50B of the swivel case 50 and through it to the boat side (to a portion that experiences no angular displacement relative to the boat 12 when the outboard motor 10 is steered) and the other end (piston rod) is fastened to the lower mount center housing 58 and through it to the outboard motor main unit 10A (to a portion that experiences angular displacement relative to the boat 12 when the outboard motor 10 is steered). In other words, the stationary member (swivel case) and steered member (lower mount center housing) are directly connected by the steering hydraulic cylinder 102, without passing through the tiller handle or a link mechanism. This enables further space-saving, prevents occurrence of excessive play, improves the steering response, and enhances steering feel. In addition, the configuration is simple and therefore does not lead to an increase in number of components or weight.

The tilt hydraulic cylinder 442, trim hydraulic cylinders 444 and hydraulic circuit 100HC are not illustrated or explained here because they are the same as those of the fourth embodiment.

As mentioned above, there is provided a steering system for an outboard motor 10 mounted on a stern of a boat 12 and having an internal combustion engine 16 at its upper portion and a propeller 22 with a rudder 23 at its lower portion that is powered by the engine to propel the boat, comprising: a swivel shaft 54 connected to the propeller to turn the propeller relative to the boat; and an electric motor 42 installed inside the outboard motor and connected to the swivel shaft to rotate the swivel shaft such that the propeller is turned by rotation of the electric motor.

Thus, there is provided an outboard motor steering system wherein an electric motor is installed inside the outboard motor and the output of the electric motor rotates the swivel shaft to steer the propeller, thereby enhancing steering feel by using the electric motor to enable highly responsive and accurate control. In addition, the configuration is simpler than when the steering system and outboard motor are constituted separately and therefore does not lead to an increase in number of components or weight. Moreover, owing to the fact that the electric motor never projects outside the profile of the outboard motor main unit regardless of the rudder angle of the outboard motor, constriction of the space around the outboard motor 10 is avoided and the amount of required installation space can be reduced without causing interference between outboard motors when two outboard motors are installed side by side in a dual motor configuration.

In the system, the swivel shaft is rotatably accommodated inside a swivel case 50 and the electric motor is fixed at an upper portion 50A of the swivel case to rotate the swivel shaft, and the electric motor is connected to a mount frame that is connected to the swivel shaft in such a manner that the electric motor rotates the mount frame through a gearbox 66 similarly fixed inside the outboard motor so as to steer the propeller. Thus the electric motor is fastened to the upper portion of the swivel case and operates through gears to steer the propeller by rotating the mount frame fastened to the swivel shaft, thereby enabling the electric motor (drive section) and mount frame (steered section) to be aligned on the same straight line so as to achieve further space-saving, prevent occurrence of excessive play, improve steering response, and enhance steering feel.

In the system, the gearbox includes gears 42*a*, etc. which mesh with a mount frame gear 56*a* to transmit the rotation of the electric motor to the mount frame such that the propeller is turned by the rotation of the electric motor, and the mount frame gear 56*a* is formed on an arcuate end face of the mount frame.

In the system, the swivel shaft is rotatably accommodated inside a swivel case and the electric motor is fixed at a lower portion 50B of the swivel case 50 to rotate the swivel shaft, and the electric motor is connected to a lower mount center housing 58 that is connected to the swivel shaft in such a manner that the electric motor rotates the lower mount center housing through a gear so as to turn the propeller. The gear includes an electric motor output shaft gear 42*a* which meshes with a lower mount center housing gear 58*a* to transmit the rotation of the electric motor to the lower mount center housing such that the propeller is turned by the rotation of the electric motor, and the lower mount center housing gear 58*a* is formed on an arcuate end face of the lower mount center housing.

Thus, the electric motor is fastened to the lower portion of the swivel case and operates through gears to steer the propeller by rotating the lower mount center housing fastened to the swivel shaft, thereby enabling the electric motor (drive section) and lower mount center housing (steered section) to be aligned on the same straight line so as to achieve further space-saving, prevent occurrence of excessive play, improve steering response, and enhance steering feel.

The system further includes a cable 90 connecting the electric motor and the swivel shaft; and wherein the rotation of electric motor is transmitted to the swivel shaft through the cable such that the propeller is turned by the rotation of the electric motor. Specifically, it further includes a gear 42*a*1 fastened on an output shaft 42*a* of the electric motor 42; a gear 54*a* fastened on the swivel shaft 54; and a holder equipped on the cable to be meshed with the gears; and wherein the rotation of electric motor is transmitted to the swivel shaft through the holder of the cable and the gears such that the propeller is turned by rotation of the electric motor.

Thus, the rotation of an electric motor is transmitted to the swivel shaft through reel gears and a cable, thereby avoiding restriction of the positional relationship between the electric motor and the swivel shaft. Since the location for installing the electric motor can therefore be selected with greater freedom, further space-saving can be achieved and the electric motor can be protected against sea water, dust and the like.

Further, there is provided a steering system for an outboard motor 10 mounted on a stern of a boat 12 and having an internal combustion engine 16 at its upper portion and a propeller 22 with a rudder 23 at its lower part to be powered by the engine to propel the boat, comprising: a first hydraulic cylinder 102 for swiveling the outboard motor to turn the propeller relative to the boat; a second hydraulic cylinder (442, 444) for tilting the outboard motor relative to the boat; a hydraulic pump 446 for supplying hydraulic oil to the first hydraulic cylinder through a first oil path or line 100*a*–100*e* and to the second hydraulic cylinder through a second oil path or line 100*c*, 100*f*–100*m*, loop; an electric motor 448 connected to the hydraulic pump, the electric motor rotating in a direction to drive the hydraulic pump for supplying the hydraulic oil to the first and the second hydraulic cylinders; and hydraulic valves 100V1–100V4 provided at the first and second oil paths or lines to supply the hydraulic oil to the first and second hydraulic cylinders. The hydraulic valves comprising; ON-OFF control valves 100V1–100V2 provided at the first and second oil paths or lines; and direction switching valves 100V3–100V4 provided at the first and second oil path or lines. The second hydraulic cylinder tilt and trims the outboard motor relative to the boat, i.e., is the power tilt-trim 44.

Thus, there is provided an outboard motor steering system wherein the first hydraulic cylinder for driving the steering system and second hydraulic cylinders for driving the power tilt-trim system are supplied hydraulic oil from the same pump, thereby making the dedicated hydraulic pump for the steering system unnecessary and thus enabling reduction of system size and weight. In addition, the electric motor for driving the hydraulic pump is made to rotate in only one direction and the oil paths for operating the first hydraulic cylinder and for operating the second cylinders are each provided with the ON-OFF control valve and direction switching valve. As a result, the steering system and the power tilt-trim system can be independently controlled without mutual interference.

Furthermore, there is provided a steering system for an outboard motor 10 mounted on a stern of a boat 12 and having an internal combustion engine 16 at its upper portion and a propeller 22 with a rudder 23 at its lower portion that is powered by the engine to propel the boat, comprising: a hydraulic cylinder 102 connected to the outboard motor at one end and to the boat at other end to swivel the outboard motor relative to the boat to turn the propeller; wherein the hydraulic cylinder is located inside a vertical projection plane of a profile of the outboard motor such that the hydraulic cylinder does not project outside the profile.

With this, the outboard motor main unit is swiveled to turn the propeller by extension/contraction of the hydraulic cylinder whose one end is attached to the outboard motor main unit and other end is attached to the boat side of the outboard motor. As the configuration is therefore simple despite utilization of the hydraulic cylinder, it does not lead to an increase in number of components or weight. In a plan view taken in the gravitational direction, moreover, the hydraulic cylinder is located inside the vertical projection plane of the profile of the outboard motor main unit, so that the hydraulic cylinder never projects outside the outboard motor main unit no matter how much it extends or contracts. Therefore, no constriction of the space around the outboard motor 10 occurs and, for example, the amount of required installation space can be reduced without causing interference between outboard motors when two outboard motors are installed side by side in a dual motor configuration.

In the system, the one end of the hydraulic cylinder is fastened to an upper portion 50A of a swivel case 50 and the other end of the hydraulic cylinder is fastened to a mount frame 56. Thus, the one end of the steering hydraulic cylinder is fastened to the upper portion of the swivel case and through it to the boat side (to a portion that experiences no angular displacement relative to the boat when the outboard motor is steered) and the other end is fastened to the mount frame and through it to the outboard motor main unit (to a portion that experiences angular displacement relative to the boat when the outboard motor is steered). In other words, the stationary member (swivel case) and steered member (mount frame) are directly connected by the steering hydraulic cylinder, without passing through the tiller handle or a link mechanism. This enables further space-saving, prevents occurrence of excessive play, improves the steering response, and enhances steering feel. In addition, the configuration is simple and therefore does not lead to an increase in number of components or weight.

In the system, the one end of the hydraulic cylinder is fastened to a lower portion 50B of a swivel case 50 and the other end of the hydraulic cylinder is fastened to a lower mount center housing 58. Thus, the one end of the steering hydraulic cylinder is fastened to the lower portion of the swivel case and through it to the boat side (to a portion that experiences no angular displacement relative to the boat when the outboard motor is steered) and the other end is fastened to the lower mount center housing and through it to the outboard motor main unit (to a portion that experiences angular displacement relative to the boat when the outboard motor is steered). In other words, the stationary member (swivel case) and steered member (lower mount center housing) are directly connected by the steering hydraulic cylinder, without passing through the tiller handle or a link mechanism. This enables further space-saving, prevents occurrence of excessive play, improves the steering response, and enhances steering feel. In addition, the configuration is simple and therefore does not lead to an increase in number of components or weight.

It should be noted in the above, although the steering hydraulic cylinder 102 and the power tilt-trim unit 44 are configured to be integral, the cylinder 102 may be fastened to the stem of the hull 12 by extending oil lines 100*a*, 100*b*.

It should also be noted that, although the hydraulic pump 446 is powered by the electric motor 448, the invention should not be limited thereto.

The entire disclosure of Japanese Patent Application Nos. 2002-160321, 2002-160322 and 2002-160323 all filed on May 31, 2002, including specification, claims, drawings and summary, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A steering system of an outboard motor mounted on a stem of a boat and having an internal combustion engine at its upper portion and a propeller with a rudder at its lower portion that is powered by the engine to propel the boat, comprising:

a cowl enclosing the engine;

a hydraulic cylinder connected to the outboard motor at one end and to the boat at other end to swivel the outboard motor relative to the boat to steer the cowl, the propeller, and the engine about a vertical axis;

wherein the hydraulic cylinder is located inside vertical planes of a profile of the outboard motor when viewed along the vertical axis such that the hydraulic cylinder never projects outside the planes of the profile in any steered position of the motor.

2. A steering system according to claim 1, wherein the one end of the hydraulic cylinder is fastened to an upper portion of a swivel case and the other end of the hydraulic cylinder is fastened to a mount frame.

3. A steering system according to claim 1, wherein the one end of the hydraulic cylinder is fastened to a lower portion of a swivel case and the other end of the hydraulic cylinder is fastened to a lower mount center housing.

* * * * *

UNITED STATES PATENT AND TRADEMARK OFFICE

CERTIFICATE OF CORRECTION

PATENT NO. : 7,134,924 B2
APPLICATION NO. : 10/446966
DATED : November 14, 2006
INVENTOR(S) : Hideaki Takada et al.

It is certified that error appears in the above-identified patent and that said Letters Patent is hereby corrected as shown below:

Specification

Please change "stem" to --stern-- on Column 16, line 56.

Signed and Sealed this

Fifteenth Day of May, 2007

JON W. DUDAS
*Director of the United States Patent and Trademark Office*